US007794566B2

(12) United States Patent
Edwards et al.

(10) Patent No.: US 7,794,566 B2
(45) Date of Patent: Sep. 14, 2010

(54) METHOD OF MAKING A PAPER WEB HAVING A HIGH INTERNAL VOID VOLUME OF SECONDARY FIBERS

(75) Inventors: Steven L. Edwards, Fremont, WI (US); David W. White, Neenah, WI (US); Frank D. Harper, Neenah, WI (US); John H. Dwiggins, Neenah, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 528 days.

(21) Appl. No.: 10/964,613

(22) Filed: Oct. 15, 2004

(65) Prior Publication Data

US 2005/0103455 A1 May 19, 2005

Related U.S. Application Data

(60) Division of application No. 10/291,843, filed on Nov. 12, 2002, now Pat. No. 6,824,648, which is a division of application No. 09/329,851, filed on Jun. 11, 1999, now Pat. No. 6,511,579, which is a continuation-in-part of application No. 09/097,159, filed on Jun. 12, 1998, now abandoned.

(51) Int. Cl.

| | |
|---|---|
| ***D21H 23/14*** | (2006.01) |
| ***D21H 23/06*** | (2006.01) |
| ***D21H 23/04*** | (2006.01) |
| ***B31F 1/12*** | (2006.01) |

(52) U.S. Cl. ..... 162/183; 162/111; 162/158; 162/179; 162/164.1

(58) Field of Classification Search ..... 162/109, 162/111, 117, 164.1, 164.6, 164.3, 168.1–168.3, 162/158, 135, 181.1–181.8, 183–185
See application file for complete search history.

(56) References Cited

U.S. PATENT DOCUMENTS

| | | | | |
|---|---|---|---|---|
| 3,246,544 | A | | 4/1966 | Cooper |
| 3,507,745 | A | | 4/1970 | Fuerst |
| 3,554,862 | A | | 1/1971 | Hervey et al. |
| 3,554,863 | A | | 1/1971 | Hervey et al. |
| 3,556,932 | A | | 1/1971 | Coscia et al. |
| 3,556,933 | A | | 1/1971 | Williams |
| 3,700,623 | A | | 10/1972 | Keim |
| 3,755,220 | A | | 8/1973 | Freimark et al. |
| 3,772,076 | A | | 11/1973 | Keim |
| 3,844,880 | A | | 10/1974 | Meisel, Jr. et al. |
| 3,926,716 | A | | 12/1975 | Bates |
| 3,960,794 | A | | 6/1976 | Sander et al. |
| 4,064,213 | A | | 12/1977 | Lazorisak et al. |
| 4,094,718 | A | | 6/1978 | Czerwin |
| 4,304,625 | A | | 12/1981 | Grube et al. |
| 4,440,898 | A | | 4/1984 | Pomplun et al. |
| 4,447,294 | A | | 5/1984 | Osborn, III et al. |
| 4,452,934 | A | | 6/1984 | Swafford et al. |
| 4,501,640 | A | | 2/1985 | Soerens |
| 4,528,316 | A | | 7/1985 | Soerens |
| 4,632,730 | A | | 12/1986 | Ulubay et al. |
| 4,684,439 | A | | 8/1987 | Soerens |
| 4,720,383 | A | | 1/1988 | Drach et al. |
| 4,752,356 | A | * | 6/1988 | Taggert et al. ..... 162/198 |
| 4,753,710 | A | * | 6/1988 | Langley et al. ..... 162/164.3 |
| 4,788,243 | A | | 11/1988 | Soerens |
| 4,795,530 | A | | 1/1989 | Soerens et al. |
| 4,883,564 | A | | 11/1989 | Chen et al. |
| 4,886,579 | A | | 12/1989 | Clark et al. |
| 4,913,775 | A | | 4/1990 | Langley et al. |
| 4,925,530 | A | | 5/1990 | Sinclair et al. |
| 4,940,513 | A | | 7/1990 | Spendel et al. |
| 4,959,125 | A | | 9/1990 | Spendel et al. |
| 5,025,046 | A | | 6/1991 | Soerens |

(Continued)

FOREIGN PATENT DOCUMENTS

| | | |
|---|---|---|
| EP | 0 675 225 A | 10/1995 |

(Continued)

OTHER PUBLICATIONS

J. G. Penniman, "Maximaxing retention/drainage in pulp slurries," Paper Trade Journal, Mar. 1, 1978, pp. 52 and 54.*

Nelson et al., "Understanding Retention Problems and retention Aids," Paper Trade Journal, Sep. 21, 1964, pp. 39-42.*

T. M. Gallangher, "Retention: The key to efficient papermaking," TAPPI Oct. 1990.*

A. M., Springer, "Fundamental Strategy for Control of Retention and Drainage on a Modern Paper Machine ," TAPPI proceedings of the 1987 Papermakers conference; Apr. 6-8, 1987; Atlanta, GA. Atlanta, GA: Technical Association of the Pulp and Paper Industry; 1987: pp. 137-140.*

Stitt, "Optimization of the charge level in a secondary fiber-based operation can improve stickies/pitch control, wet-strength resin effectiveness, fiber retention," *Pulp & Paper*, May 1998, pp. 109-110, 113-114.

(Continued)

*Primary Examiner*—José A Fortuna
(74) *Attorney, Agent, or Firm*—Finnegan, Henderson, Farabow, Garrett & Dunner L.L.P.

(57) ABSTRACT

The present invention is a method of making a near-premium quality paper product having good strength and absorbency characteristics and a product made by that method. The invention is also a method for retaining a high ash content within a paper web formed by conventional wet pressing. The present invention is also a method for retaining a high percentage of softening agent within a paper web that includes such an agent. Further, the present invention is a soft absorbent paper product having a high void volume. Finally, the invention is also a method for producing a soft, absorbent, and near premium paper product having a high void volume using an undulatory crepe blade having a multiplicity of serrulations in its rake surface which presents differentiated creping angles and/or rake angles as to the paper being creped.

34 Claims, 27 Drawing Sheets

U.S. PATENT DOCUMENTS 5,059,282 A 10/1991 Ampulski et al.
5,164,046 A 11/1992 Ampulski et al.
5,185,062 A 2/1993 Begala
5,215,626 A 6/1993 Ampulski et al.
5,217,576 A 6/1993 Van Phan et al.
5,221,435 A * 6/1993 Smith, Jr. ..... 162/164.1
5,223,096 A 6/1993 Phan et al.
5,225,047 A 7/1993 Graef et al.
5,227,242 A 7/1993 Walter et al.
5,240,562 A 8/1993 Phan et al.
5,246,546 A 9/1993 Ampulski et al.
5,262,007 A 11/1993 Phan et al.
5,264,082 A 11/1993 Phan et al.
5,279,767 A 1/1994 Phan et al.
5,281,307 A 1/1994 Smigo et al.
5,312,522 A 5/1994 Van Phan et al.
5,326,434 A 7/1994 Carevic et al.
5,334,286 A 8/1994 Van Phan et al.
5,354,425 A 10/1994 Mackey et al.
5,374,334 A 12/1994 Sommese et al.
5,382,323 A 1/1995 Furman, Jr. et al.
5,385,642 A 1/1995 Van Phan et al.
5,397,435 A 3/1995 Ostendorf et al.
5,399,240 A 3/1995 Graef et al.
5,399,241 A 3/1995 Oriaran et al.
5,405,501 A 4/1995 Phan et al.
5,415,737 A 5/1995 Phan et al.
5,427,696 A 6/1995 Phan et al.
5,437,766 A 8/1995 Van Phan et al.
5,474,689 A 12/1995 Laughlin et al.
5,482,595 A * 1/1996 Harrington et al. ..... 162/168.3
5,487,813 A 1/1996 Vinson et al.
5,494,731 A 2/1996 Fereshtehkhou et al.
5,510,000 A 4/1996 Phan et al.
5,514,249 A 5/1996 Cauley et al.
5,538,595 A 7/1996 Trokhan et al.
5,543,067 A 8/1996 Phan et al.
5,573,637 A 11/1996 Ampulski et al.
5,575,891 A 11/1996 Trokhan et al.
5,582,681 A 12/1996 Back et al.
5,611,890 A 3/1997 Vinson et al.
5,618,858 A 4/1997 Hauschildt et al.
5,635,028 A 6/1997 Vinson et al.
5,656,746 A * 8/1997 Smith et al. ..... 536/63
5,672,249 A 9/1997 Vinson et al.
5,676,796 A 10/1997 Cutts
5,690,788 A 11/1997 Marinack et al.
5,695,607 A 12/1997 Oriaran et al.
5,695,609 A 12/1997 Petander et al.
5,698,076 A 12/1997 Phan et al.
5,700,352 A 12/1997 Vinson et al.
5,733,414 A 3/1998 Stockwell
5,830,317 A 11/1998 Vinson et al.
5,928,470 A 7/1999 Shannon
5,958,185 A 9/1999 Vinson et al.
6,017,418 A 1/2000 Oriaran et al.
6,033,523 A 3/2000 Dwiggins et al.
6,153,053 A 11/2000 Harper et al.
6,159,335 A * 12/2000 Owens et al. ..... 162/9
6,296,737 B1 10/2001 Wu et al.
6,315,866 B1 11/2001 Sanchez
6,358,365 B1 3/2002 Zhang et al.
6,379,501 B1 4/2002 Zhang et al.
6,419,789 B1 7/2002 Yeh et al.
6,511,579 B1 1/2003 Edwards et al.
6,579,416 B1 6/2003 Vinson et al.
6,607,637 B1 8/2003 Vinson et al.
6,824,648 B2 * 11/2004 Edwards et al. ..... 162/111
6,969,443 B1 * 11/2005 Kokko ..... 162/5
6,998,016 B2 * 2/2006 Yeh et al. ..... 162/109
2002/0074100 A1 6/2002 Yeh et al.
2003/0127206 A1 7/2003 Barnholtz et al.
2004/0082668 A1 * 4/2004 Vinson ..... 516/38
2005/0103455 A1 * 5/2005 Edwards et al. ..... 162/111
2006/0042767 A1 * 3/2006 Bhat et al. ..... 162/117
2006/0060319 A1 * 3/2006 Kokko ..... 162/158

FOREIGN PATENT DOCUMENTS

EP 707945 A2 * 4/1996
EP 0 835 957 4/1998
EP 851061 A2 * 7/1998
EP 1013825 A1 * 6/2000
EP 1157818 A1 * 11/2001
EP 1398413 A2 * 3/2004
WO WO 98/23813 6/1998
WO WO 9964673 A1 * 12/1999

OTHER PUBLICATIONS

Kirk-Othmer, *Encyclopedia of Chemical Technology*, Papermaking Additives, vol. 18, 4th Ed.
Evans, *Chemistry and Industry*, Jul. 5, 1969, pp. 893-903.
Egan, *J. Am. Oil Chemist's Soc.*, vol. 55, 1978, pp. 118-121.
Trivedi et al., *J. Am. Oil Chemist's Soc.*, Jun. 1981, pp. 754-756.
Westfelt, *Cellulose Chemistry and Technology*, vol. 13, 1979, p. 813.
Espy, "Wet-Strength Resins and Their Application," *Alkaline-Curing Polymeric Amine-Epichlorohydrin*, Ch. 2, L. Chan, Editor, 1994.
Enbehend et al., "Pulp and Paper, Chemistry and Chemical Technology," *Retention Chemistry*, vol. 3, 3rd Ed., Ch. 17.
Kirk-Othmer, *Encyclopedia of Chemical Technology*, vol. 14, 4th Ed., 1992, pp. 22-25, 27.
Casey, James P., "Pulp and Paper, Chemistry and Chemical Technology," vol. II, Jan. 1952, pp. 938-943.
Smook, Gary A., *Handbook for Pulp and Paper Technologists*, 1992, p. 309.
*Dictionary of Paper*, TAPPI, 5th Ed., 1996, p. 204.
U.S. Appl. No. 10/291,843, filed Nov. 12, 2002.
U.S. Appl. No. 09/097,159, filed Jun. 12, 1998.

* cited by examiner

| DIM# | DESCRIPTION | DIM (mils) |
|---|---|---|
| 1 | LENGTH, TOP OF MALE ELEMENT | 2.3 |
| 2 | LENGTH, BOTTOM OF FEMALE ELEMENT | 2.3 |
| 3 | CD REPEAT OF MICRO | 92.5 |
| 4 | LENGTH, OPENING OF FEMALE ELEMENT | 35 |
| 5 | LENGTH, BASE OF MALE ELEMENT | 35 |
| 6 | WIDTH, TOP OF MALE ELEMENT | 23 |
| 7 | NO REPEAT OF MICRO | 92.5 |
| 8 | WIDTH, BASE OF FEMALE ELEMENT | 23 |
| 9 | WIDTH, OPENING OF FEMALE ELEMENT | 35 |
| 10 | WIDTH, BASE OF MALE ELEMENT | 35 |
| 11 | TOP OF MALE TO DEPTH OF FEMALE | 31 |
| 12 | TOP OF MALE TO MIDPLANE | 15.5 |
| 13 | MIDPLANE TO BOTTOM OF FEMALE | 15.5 |
| 14 | BOTTOM OF FEMALE DOME | 53 |

| DIM# | DESCRIPTION | DIM (mils) |
|---|---|---|
| 15 | OPENING FOR FEMALE DOME | 77 |
| 16 | BOTTOM OF FEMALE TULIP LINE | 20 |
| 17 | OPENING FOR FEMALE TULIP LINE | 44 |
| 18 | DEPTH OF FEMALE DOME | 31 |
| 19 | DEPTH OF FEMALE TULIP LINE | 31 |

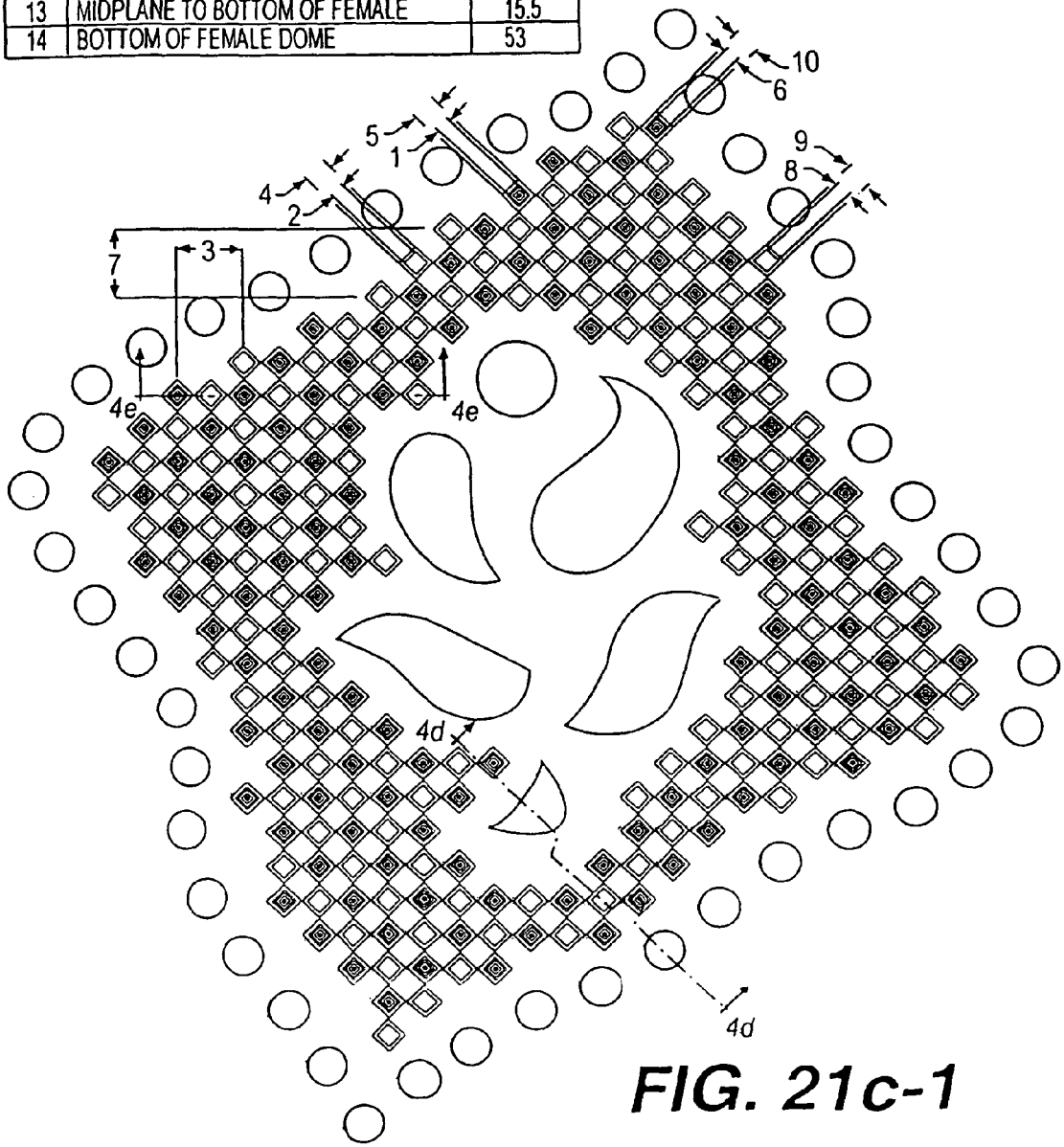

FIG. 21c-1

METHOD OF MAKING A PAPER WEB HAVING A HIGH INTERNAL VOID VOLUME OF SECONDARY FIBERS

RELATED APPLICATIONS

This application is a divisional of Application Ser. No. 10/291,843 filed Nov. 12, 2002, which is a divisional of Application Ser. No. 09/329,851 filed Jun. 11, 1999 (now U.S. Pat. No. 6,511,579), which is a continuation-in-part of Application Ser. No. 09/097,159 filed Jun. 12, 1998 (now abandoned), all of which are incorporated herein by reference in their entireties.

FIELD OF THE INVENTION

The invention relates to a method of making a paper web that exhibits high internal void volume from a furnish having a substantial amount of ash, fines and/or secondary fibers. More particularly, the invention relates to a method for making a near-premium quality strong and soft paper web from inexpensive secondary fibers that contain high levels of ash and fines. Still more particularly, the present invention relates to a paper product made according to the present invention. Further, the present invention relates to a method of making a paper web having improved softener retention and/or strength-adjusting agent efficiency. Finally, the present invention relates to a method of making an embossed paper product with conventional and mated embossing and an undulatory crepe blade to make a softer, thicker web with higher cross-directional stretch.

BACKGROUND OF THE INVENTION

The current market for products made from soft absorbent paper webs has long been split between premium products and economy products. Commercial paper toweling, dispenser napkins and single-ply tissue products are often relegated to the economy value market because they have often been made from inexpensive recycled fibers resulting in thin and/or rough products, often having poor absorbency. It was heretofore difficult to make soft absorbent paper webs having sufficient strength, softness and absorbency to qualify as premium or near-premium quality without resorting to more expensive virgin fibers and/or expensive processing methods.

Through air drying (TAD) has changed the industry's ability to produce soft, bulky, premium quality paper products, particularly in the area of single-ply products. TAD has become the preferred choice for newly purchased paper machines because it can provide improved product attributes and therefore, economic advantages to manufacturers when compared with the products produced by conventional wet pressing (CWP). The advent of TAD has made it possible to produce paper products with good initial softness and bulk.

In the older conventional wet pressing method, premium quality paper products, tissues and towels, are normally made by embossing together two thin plies. In this way, the rougher air-side surfaces (i.e., those surfaces not previously in contact with the surface of the Yankee dryer) can be made to face inward, thereby being concealed within the two-ply sheet. However, embossing two-plies together imposes marked economic disadvantages over single-ply paper TAD sheets.

Conventional wet pressing, however, has certain advantages over TAD including 1) lower energy costs associated with the mechanical removal of water rather than drying by the passage of hot air; and 2) increased production speeds.

Stated differently, energy consumption is lower and the production speeds can be considerably higher than those used in TAD.

Conversion of existing CWP machines to TAD capability is both difficult and expensive. What is needed is a method of making premium quality, or near-premium quality paper products using conventional wet pressing from recycled fiber. More preferably, a premium quality or near-premium quality two-ply and even more preferably a single-ply product should be produced from inexpensive and recycled fibers without the need for significant preprocessing of the fibers to remove ash and fines.

Attempts have been made to produce products from recycled fiber using CWP that can compete with TAD products, but these processes often suffer from limitations making it necessary to use more expensive virgin fibers to achieve an acceptable product. One common method of increasing the softness and cushion of bathroom tissue is to crepe the paper. Creping is generally accomplished by fixing the cellulosic web to a Yankee drier with an adhesive/release agent combination and then scraping the web off the Yankee by means of a creping blade. Creping, by breaking a significant number of inter-fiber bonds, adds to and increases the softness of resulting bathroom tissue product. However, creping with a conventional blade may not provide the most preferred combinations of softness, bulk and appearance.

According to one preferred embodiment of the present invention, we have discovered that tissue having highly desirable bulk, appearance and softness characteristics, can be produced by a process similar to conventional processes, particularly conventional wet pressing, except that the conventional creping blade is replaced with the patented undulatory creping blade disclosed in U.S. Pat. No. 5,690,788,[1] presenting differentiated creping and rake angles to the sheet and having a multiplicity of spaced serrulated creping sections of either uniform depths or non-uniform arrays of depths. The depths of the undulations are above about 0.008 inches.

[1]U.S. Pat. No. 5,690,788 is herein incorporated by reference in its entirety.

The present invention makes it possible to use inexpensive secondary fiber that may contain significant amounts of ash and fines and yet, achieve a premium or near-premium quality paper product. The paper products made according to the present invention exhibit characteristics approaching the much more expensive TAD products. Moreover, products made using the patented undulatory blade to crepe the web will have a crepe fineness similar to that of conventionally-made tissue sheets, but the resulting web combines crepe bars extending in the cross direction with undulations extending in the machine direction. The resultant product will have a lower tensile strength and a higher caliper and cross-directional stretch than is found when using a conventional crepe blade.

SUMMARY OF THE INVENTION

Further advantages of the invention will be set forth in part in the description which follows and in part will be apparent from the description. The advantages of the invention may be realized and attained by means of the instrumentalities and combinations particularly pointed out in the appended claims.

To achieve the foregoing advantages and in accordance with the purpose of the invention, as embodied and broadly described herein, there is disclosed:

A method for forming a soft absorbent paper product including, supplying an aqueous stream including fibers to form a furnish;

adding a charge modifier to the furnish where the charge modifier contacts the furnish for a time sufficient to reduce the charge in the furnish;

adding a debonder or wet strength adjusting agent to the furnish, after the charge has been reduced;

adding a retention aid to the furnish after the debonder or wet strength adjusting agent has been in contact with the furnish for a time sufficient to allow distribution of the debonder or wet strength adjusting agent on the fibers;

supplying the furnish to a headbox, and where the furnish has a consistency of not greater than 0.9% as supplied to the headbox;

applying the furnish to a forming wire and forming a nascent web; and drying the web to form a paper product.

There is further disclosed:

A soft absorbent paper product comprising a web formed by conventional wet pressing of a cellulosic web, adhering the web to a Yankee and creping the web from said Yankee including:

fibers including secondary fibers having at least 1% ash;

and wherein the web has a void volume of:

$$\text{void volume} \geqq 8.4-(0.2\times\text{Basis Weight}).$$

There is still further disclosed:

A soft absorbent paper product comprising a web formed by through air drying comprising:

fibers including secondary fibers having at least 1% ash;

and wherein the web has a void volume of:

$$\text{void volume} \geqq 8.4-(0.2\times\text{Basis Weight}).$$

There is also disclosed:

A method for improving the retention of a softener or debonder in a web produced from a furnish containing contaminants selected from ash, fines, filler and mixtures thereof including:

adding to the furnish a charge-modifying agent capable of neutralizing the charge on the contaminants;

allowing the charge-modifying agent to contact the furnish for a time sufficient to neutralize charge on the contaminants;

adding to the furnish a softener or debonder;

adding to the furnish a retention aid;

forming a nascent web from the furnish; and drying the web.

There is still further disclosed:

A method of incorporating ash or filler into a soft absorbent web including;

providing a furnish containing ash or filler;

adding to the furnish a charge modifier capable of neutralizing charge on the ash or filler;

allowing the charge modifier to contact the furnish for a time sufficient to neutralize charge on the ash or filler;

adding to the furnish a debonder or wet strength adjusting agent;

adding to the furnish a retention aid;

forming a nascent web from the furnish; and drying said web.

Further there is disclosed:

A method for improving the efficiency of a strength-adjusting agent in a web produced from a furnish containing contaminants selected from ash, fines, filler and mixtures thereof including:

adding to the furnish a charge-modifying agent capable of reducing the charge on the contaminants;

allowing the charge-modifying agent to contact the furnish for a time sufficient to reduce the charge on the contaminants;

adding a strength-adjusting agent to the furnish;

adding a retention aid to the furnish;

forming a nascent web from the furnish; and drying the web.

There is still further disclosed:

A method for forming a soft absorbent paper product including, supplying an aqueous stream including fibers to form a furnish;

adding a charge modifier to the furnish where the charge modifier contacts the furnish for a time sufficient to reduce the charge in the furnish;

adding a debonder or wet strength adjusting agent to the furnish, after the charge has been reduced;

adding a retention aid to the furnish after the debonder or wet strength adjusting agent has been in contact with the furnish for a time sufficient to allow distribution of the debonder or wet strength adjusting agent on the fibers;

supplying the furnish to a headbox, and where the furnish has a consistency of not greater than 0.9% as supplied to the headbox;

applying the furnish to a forming wire and forming a nascent web; and drying the web to form a paper product;

where the drying step comprises:

compactively dewatering the nascent web;

applying the web to a Yankee drier and drying the web; and creping the web from the Yankee drier at a moisture content of less than 50%;

where the web is creped using an undulatory crepe blade which produces the absorbent paper product, the web having a machine direction and a cross-machine direction and the web having a Yankee side and an air side, comprising a biaxially undulatory cellulosic fibrous web characterized by a reticulum of intersecting undulation and crepe bars, the crepe bars extending transversely in the cross-machine direction, the undulation defining:

interspersed ridges and furrows extending longitudinally in the machine direction on the air side of the sheath;

along with interspersed crests and serrations disposed on the Yankee side of the web, wherein the spatial frequency of the transversely extending crepe bars is from about 8 to about 150 crepe bars per inch, and the spatial frequency of the longitudinally extending ridges is from about 8 to 50 ridges per inch.

The accompanying drawings, are included to provide a further understanding of the invention and are incorporated in and constitute a part of the specification. The drawings illustrate embodiments of the invention and, together with the description, serve to explain the principles of the invention.

BRIEF DESCRIPTION OF THE DRAWINGS

FIG. 21*a* shows the actual size of the pattern of one preferred mated emboss pattern that can be used to mask the undulatory serrations caused by use of the patented undulatory blade.

FIG. 21*b* shows the micro or fill elements of one preferred mated emboss pattern that can be used to mask the undulatory serrations caused by use of the patented undulatory blade.

FIG. 21*c* shows an enlargement of the micro or macro elements of one preferred mated emboss pattern that can be used to mask the undulatory serrations caused by use of the patented undulatory blade.

DETAILED DESCRIPTION

The present invention is a paper product made, preferably, using conventional wet pressing, from a fiber furnish having significant amounts of ash and fines. The resulting product has good internal void volume, good strength and softness.

Paper products according to the present invention may be manufactured on any papermaking machine of conventional forming configurations such as fourdrinier, twin-wire, suction breast roll or crescent forming configurations. The forming mode is advantageously water or foam. The drying method is advantageously conventional wet pressing but can be any known drying form including, for example, through-air-drying (TAD), can drying or impulse drying.

Figure 1:
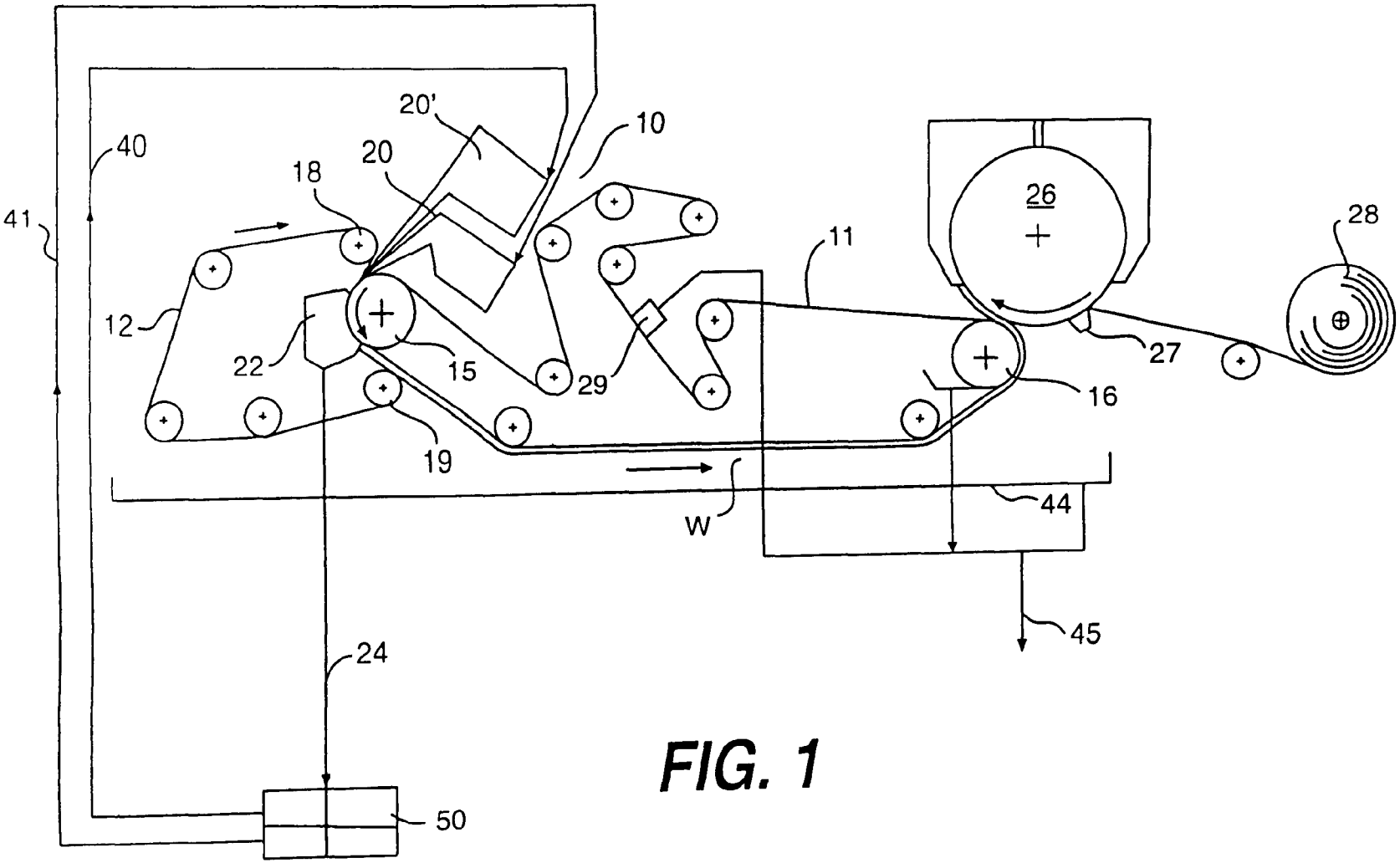
FIG. 1 illustrates a conventional dry crepe, wet-pressing papermaking process having multiple headboxes.
Figure 2:
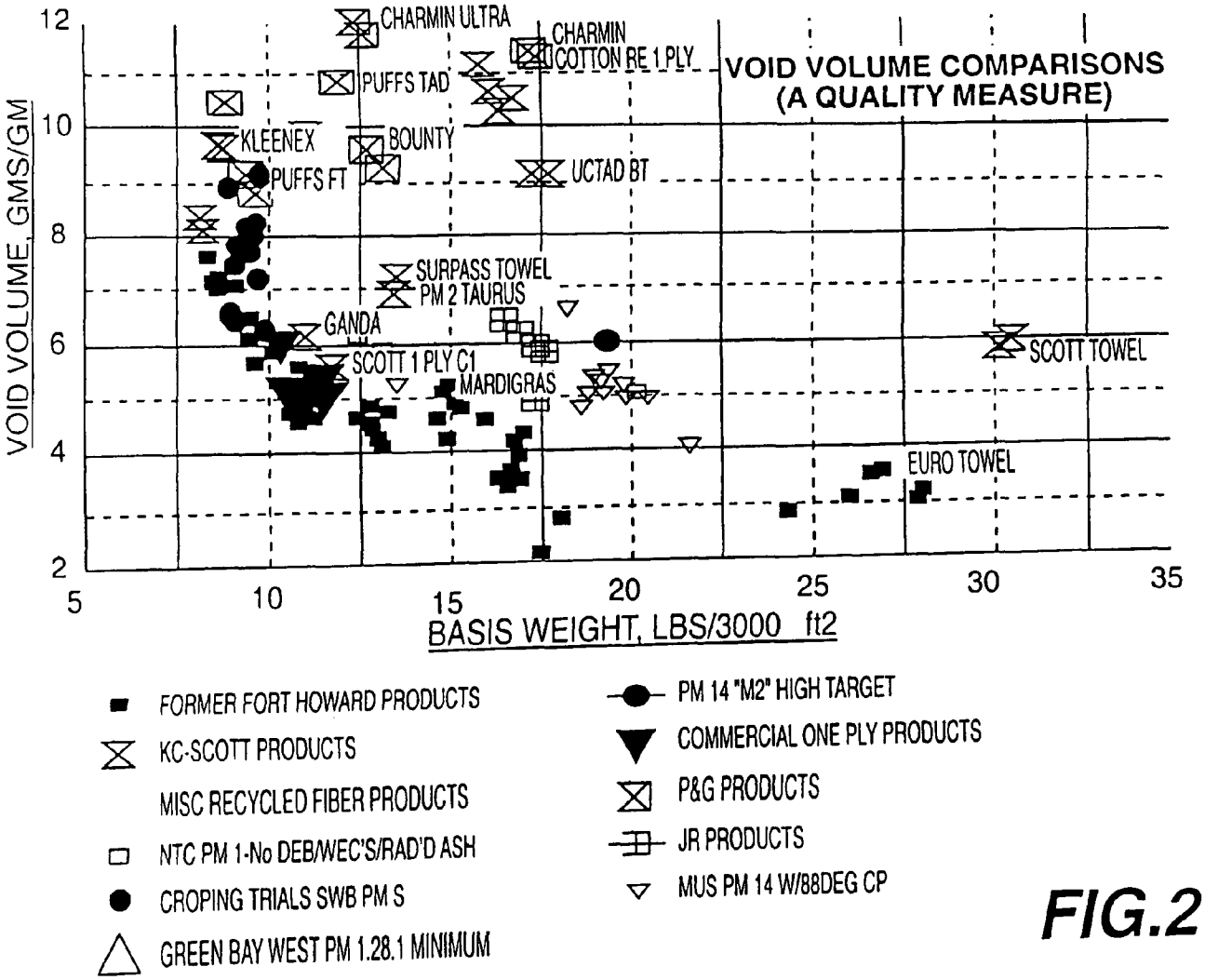
FIG. 2 illustrates the relationship between basis weight and void volume for current market products and products according to the present invention.

FIG. 1 illustrates one embodiment of the present invention where a machine chest 50, which may be compartmentalized, is used for preparing furnishes that are treated with chemicals having different functionality depending on the character of the various fibers used. This embodiment shows a divided headbox thereby making it possible to produce a stratified product. The product according to the present invention can be made with single or multiple headboxes and regardless of the number of headboxes may be stratified or unstratified. The treated furnish is transported through different conduits 40 and 41, where it is delivered to the headbox of a crescent forming machine 10, although any convenient configuration can be used.

FIG. 1 shows a web-forming end or wet end with a liquid permeable foraminous support member 11 which may be of any convenient configuration. Foraminous support member 11 may be constructed of any of several known materials including photopolymer fabric, felt, fabric or a synthetic filament woven mesh base with a very fine synthetic fiber batt attached to the mesh base. The foraminous support member 11 is supported in a conventional manner on rolls, including breast roll 15 and pressing roll 16.

Forming fabric 12 is supported on rolls 18 and 19 which are positioned relative to the roll 15 for guiding the forming wire 12 to converge on the foraminous support member 11 at the cylindrical roll 15 at an acute angle relative to the foraminous support member 11. The foraminous support member 11 and the wire 12 move at the same speed and in the same direction which is the direction-of rotation of the roll 15. The forming wire 12 and the foraminous support member 11 converge at an upper surface of the forming roll 15 to form a wedge-shaped space or nip into which one or more jets of water or foamed liquid fiber dispersion may be injected and trapped between the forming wire 12 and the foraminous support member 11 to force fluid through the wire 12 into a saveall 22 where it is collected to reuse in the process.

The nascent web W formed in the process is carried by the foraminous support member 11 to the pressing roll 16 where the wet nascent web W is transferred to the Yankee dryer 26. Fluid is pressed from the wet web W by pressing roll 16 as the web is transferred to the Yankee dryer 26 where it is dried and creped by means of a creping blade 27. The finished web is collected on a take-up roll 28.

A pit 44 is provided for collecting water squeezed from the furnish by the press roll 16, as well as collecting the water removed from the fabric by a Uhle box 29. The water collected in pit 44 may be collected into a flow line 45 for separate processing to remove surfactant and fibers from the water and to permit recycling of the water back to the papermaking machine 10.

The web according to the present invention can be made using fibers well known to the skilled artisan. These fibers may be cellulose based fibers, synthetic fibers, or mixtures thereof. Preferred fibers are cellulose based and include softwood, hardwood, chemical pulp obtained from softwood and/or hardwood by treatment with sulfate or sulfite moieties, mechanical pulp obtained by mechanical treatment of softwood and/or hardwood, recycle fiber, refined fiber and the like.

Papermaking fibers used to form the soft absorbent products of the present invention include cellulosic fibers commonly referred to as wood pulp fibers, liberated in the pulping process from softwood (gymnosperms or coniferous trees) and hardwoods (angiosperms or deciduous trees). The particular tree and pulping process used to liberate the tracheid are not critical to the success of the present invention. Cellulosic fibers from diverse material origins may be used to form the web of the present invention, including non-woody fibers liberated from sabai grass, rice straw, banana leaves, paper mulberry (i.e. bast fiber), abaca leaves, pineapple leaves, esparto grass leaves, and fibers from the genus hesperalae in the family agavaceae. Also recycled fibers which may contain any of the above fiber sources in different percentages can be used in the present invention.

Papermaking fibers can be liberated from their source material by any one of the number of chemical pulping processes familiar to the skilled artisan including sulfate, sulfite, polysulfide, soda pulping, etc. The pulp can be bleached if desired by chemical means including the use of chlorine, chlorine dioxide, oxygen, etc. Furthermore, papermaking fibers can be liberated from source material by any one of a number of mechanical/chemical pulping processes familiar to anyone experienced in the art including mechanical pulping, thermomechanical pulping, and chemithermomechanical pulping. These mechanical pulps can be bleached, if one wishes, by a number of familiar bleaching schemes including alkaline peroxide and ozone bleaching.

Fibers for use according to the present invention can also be obtained primarily from recycling of pre- and post-consumer paper products. Fiber may be obtained, for example, from the recycling of printers' trims and cuttings, including book and clay coated paper, post consumer paper including office and curbside paper recycling and old newspaper.

The various collected papers can be recycled using means common to the recycled paper industry. The papers may be sorted and graded prior to pulping in conventional low-, mid-, and high-consistency pulpers. In the pulpers the papers are mixed with water and agitated to break the fibers free from the sheet. Chemicals common to the industry may be added in this process to improve the dispersion of the fibers in the slurry and to improve the reduction of contaminants that may be present. Following pulping the slurry is usually passed through various sizes and types of screens and cleaners to remove the larger solid contaminants while retaining the fibers. It is during this process that such waste contaminants as paper clips and plastic residuals are removed.

The pulp is then generally washed to remove smaller sized contaminants consisting primarily of inks, dyes, fines and ash. This process is generally referred to as deinking. Deinking, in the modern sense, refers to the process of making useful pulp from wastepaper while removing an ever increasing variety of objectionable, noncellulosic materials.

One example of a deinking process by which fiber for use in the present invention can be obtained is called floatation. In this process small air bubbles are introduced into a column of the furnish. As the bubbles rise they tend to attract small particles of dye and ash. Once upon the surface of the column of stock they are skimmed off. At this point the pulp may be relatively clean but is often low in brightness. Paper made from this stock can have a dingy, gray appearance, not really suitable for near-premium product forms.

To increase the brightness the furnish is often bleached. Bleaching can be accomplished by a number of means including, but not limited to, bleaching with chlorine, hypochlorite, chlorine dioxide, oxygen, peroxide, hydrosulfite, or any other commonly used bleaching agents. The types and amounts of bleaching agents depend a great deal on the nature of the wastepaper being processed and upon the level of desired brightness. Generally speaking, unbleached waste papers can have brightness levels between 60 to 80 on the G.E. brightness scale, depending upon the quality of the paper being recycled. Bleached waste papers can range between the same levels and may extend up to about 90, however, this brightness level is highly dependent upon the nature of the waste papers used.

Since the cost of waste paper delivered to the pulp processing plant is related to the cleanliness and quality of the fibers in the paper, it is advantageous to be able to upgrade relatively low cost waste papers into relatively high value pulp. However, the process to do this can be expensive not only in terms of machinery and chemical costs but also in lost yield. Yield is defined as the percentage by weight of the waste paper purchased that finally ends up as pulp produced. Since the lower cost waste papers generally contain more contaminants, especially relatively heavy clays and fillers generally associated with coated and writing papers, removal of these contaminants can have a dramatic effect on the overall yield of pulp obtainable. Such low yields also translate into increased amounts of material that must be disposed of in landfills or by other means.

In addition, as the ash levels are reduced, fines and small fibers are also lost since there is currently no ash-specific removal process in use which removes only ash without taking small fibers and fines. For example, if a pulp of 70 percent yield can be used rather than a "cleaner" 50 percent yield the savings in pulp cost due to more fiber and less waste removal is significant.

Generally, premium grade products are not made using a major amount of secondary recycle fibers, let alone being made entirely from secondary recycle fibers. Recycled fibers suffer from problems with low brightness, and slow furnish dewatering resulting in poor drainage on the forming wire and necessitating slower machine speeds. Base sheets made with a high percentage or 100% recycled fibers are very dense. Therefore, their strength does not break down as much during creping. This results in harsh, high strength, creped paper, especially for relatively high base weights of >10 lbs/ream. Prior to the present invention, it has been understood that to include recycle fibers in premium or near premium sheets, it is necessary to preprocess the fibers to render them substantially free from ash. This inevitably increases cost. Failing to remove the ash is believed to create often insurmountable problems with drainage or formation. If sufficient water is added to the stock to achieve good web formation, the forming wire sections often flood. If the water is reduced to prevent this flooding problem, there are often severe problems in forming a substantially homogeneous web. The present invention addresses these difficulties encountered when using high ash content fibers, e.g., secondary recycled fibers.

The product according to the present invention is made from a furnish that contains both ash and fines and/or fillers. Fillers according to the present invention include any prior art recognized fillers that are generally used to reduce fiber content in the production of bulky absorbent paper products. Typical fillers include structured kaolins, however, selection of appropriate fillers will be within the ordinary skill of the artisan.

The preferred furnishes according to the present invention contain significant amounts of secondary fibers that possess significant amounts of ash and fines. It is common in the industry to hear the term ash associated with virgin fibers. This is defined as the amount of ash that would be created if the fibers were burned. Typically no more than about 0.1% to about 0.2% ash is found in virgin fibers. Ash as used in the present invention includes this "ash" associated with virgin fibers as well as contaminants resulting from prior use of the fiber.

Furnishes according to the invention include excess amounts of ash greater than about 1%. Ash originates when fillers or coatings are added to paper during formation of a filled or coated paper product. Ash will typically be a mixture containing titanium dioxide, kaolin clay, calcium carbonate and/or silica. This excess ash or particulate matter is what has traditionally interfered with processes using recycled fibers, thus making the use of recycled fibers unattractive. In general recycled paper containing high amounts of ash is priced substantially lower than recycled papers with low or insignificant ash contents. Thus, there will be significant advantage to a process for making a premium or near-premium product from recycled paper containing excess amounts of ash.

Furnishes containing excess ash also typically contain significant amount of fines. Ash and fines are most often associated with secondary, recycled fibers, post-consumer paper and converting broke from printing plants and the like. Secondary, recycled fibers with excess amounts of ash and significant fines are available on the market and are quite cheap because it is generally accepted that only very thin, rough, economy towel and tissue products can be made unless the furnish is processed to remove the ash. The present invention makes it possible to achieve a paper product with high void volume and premium or near-premium qualities from secondary fibers having significant amounts of ash and fines without any need to preprocess the fiber to remove fines and ash. While the present invention contemplates the use of fiber mixtures, including the use of virgin fibers, most fiber in the products according to the present invention will have greater than 0.75% ash, more preferably greater than 1% ash. Still more preferably, the fiber will have greater than 2% ash and may have as high as 30% ash or more.

As used in the present invention, fines constitute material within the furnish or product that will pass through a 100 mesh screen. Ash and ash content is defined as above and can be determined using TAPPI Standard Method T211 om-93.

In a most preferred embodiment of the present invention, a premium or near-premium-quality product is produced using a mixture of secondary fibers from a blend of recycled papers, including for example, printers' trim and cuttings and post consumer paper.

The dispersion of the fibers to form a furnish is accomplished by the addition of water and includes the use of chemical additives to alter the physical properties of the paper produced. The initial additive included in the furnish according to the present invention is the charge modifier. Since the fines and ash components (e.g., clays, calcium carbonate, titanium dioxide, etc.) are anionic, charge neutralization is advantageously accomplished by addition of cationic materials to the overall system. A charge modifier according to the present invention is a material that when added to the fiber furnish serves to reduce the charge on the fine fraction of the furnish (passing through-80-mesh) by about 30% to about 98%. The charge modifier preferably reduces the charge on the through-80-mesh fraction of the furnish to between about 30% and about 95% of its original value, more preferably to between about 50% and about 80% of its original value. In a most preferred embodiment, the charge modifier reduces the charge on the through-80-mesh fraction of the furnish by about 70%.

A charge modifier is preferably added in an amount of from about 1 to about 10 lbs/ton, more preferably from about 1 to about 8 lbs/ton, and most preferably from about 2 to about 6 lbs/ton.

Surprisingly, it appears that one reason for the improved properties of products made according to the present invention is an increase in effectiveness of the debonder or strength-adjusting agent due to the presence of the charge-modifying agent. The charge-modifying agent should not interfere with the desired product attributes. The charge-modifying agent should contact the furnish for a time sufficient to neutralize substantially all of the anionic charge on the ash and fines. In one embodiment, the charge modifier may be left in contact with the furnish for up to 2 days. Generally, the charge modifier preferably contacts the furnish for from about 10 seconds to about 45 minutes before any debonder and/or softener is added to the furnish, more preferably from about 20 seconds to about 30 minutes, most preferably from about 1 minute to 15 minutes.

Appropriate charge-modifying agents can be selected from linear or branched synthetic polymers having molecular weights of less than about 1 million. For branched polymers, the molecular weights are preferably below about 750,000. The more preferred charge-modifying agents are relatively low-molecular-weight cationic linear synthetic polymers preferably having molecular weights of no more than about 500,000 and more preferably not more than about 300,000. The charge densities of such low-molecular-weight cationic synthetic polymers are relatively high. These charge densities range from about 4 to about 12 equivalents of cationic nitrogen per kilogram of polymer.

Suitable charge-modifying agents include inorganic salts such as alum or aluminum chloride and their polymerization products (e.g. PAC or polyaluminum chloride or synthetic polymers); poly(diallyldimethyl ammonium chloride) (i.e., DADMAC); poly(dimethylamine)-co-epichlorohydrin; polyethyleneimine; poly(3-butenyltrimethylammonium chloride); poly(4-ethenylbenzyltrimethylammonium chloride); poly (2,3-epoxypropyltrimethylammonium chloride); poly(5-isoprenyltrimethylammonium chloride); and poly (acryloyloxyethyltrimethylammonium chloride). Other suitable cationic compounds having high charge-to-mass ratios include all polysulfonium compounds, such as, for example, the polymer made from the adduct of 2-chloromethyl; 1,3-butadiene and a dialkylsulfide, all polyamines made by the reaction of amines such as, for example, ethylenediamine, diethylenetriamine, triethylenetetraamine or various dialkylamines, with bis-halo, bis-epoxy, or chlorohydrin compounds such as, for example, 1-2 dichloroethane, 1,5-diepoxyhexane, or epichlorohydrin; all polymers of guanidine such as, for example, the product of guanidine and formaldehyde with or without polyamines.

Commercially available suitable charge-modifying agents include Cypro® 514, a product of Cytec, Inc. of Stamford, Conn; Bufloc® 5031 and Bufloc® 534, both products of Buckman Laboratories, Inc. of Memphis, Tenn.; and Quaker 3190, a product of Quaker Chemical Corp. of Conshohocken, Pa.

The charge-modifying agent is preferably selected from low-molecular-weight, high charge density polymers.

Preferred charge modifiers are polydiallyldimethylammonium chloride (DADMAC) having molecular weights of about 90,000 to about 300,000, polyamines having molecular weights of about 50,000 to about 300,000 and polyethyleneimine having molecular weights of about 40,000 to about 750,000.

After the charge-modifying agent has been in contact with the furnish for a time sufficient to reduce the charge on the furnish, a debonder can be added. In the production of tissue a debonder is frequently added, however in the production of towels and napkins, a debonder is optional. Suitable debonders will be readily apparent to the skilled artisan and suitable debonders are widely described in the patent literature. A comprehensive but non-exhaustive list includes U.S. Pat. Nos. 4,795,530; 5,225,047; 5,399,241; 3,844,880; 3,554,863; 3,554,862; 4,795,530; 4,720,383; 5,223,096; 5,262,007; 5,312,522; 5,354,425; 5,145,737, and EPA 0 675 225, each of which is specifically incorporated herein by reference in its entirety.

Whether or not a molecule acts as a debonder or softener depends largely on where it is added in the process. In general, wet end addition brings about both debonding and softening, whereas spray application favors softening. In general, any surface-active molecule will debond paper if it can get into and stay within the fibers and the inter-fiber-bonding region. The longer the chain length on the hydrophobic chains on the molecule, the better; with two chains per molecule being best. An exception is where the carbon chain length exceeds 20; then, a single chain per molecule is better.

Preferred debonders/softeners for use in the present invention are those belonging to the class of imidazolinium compounds prepared by reacting two fatty acids or esters with a polyalkylene polyamine, and then alkylating the product with an alkylating agent such as methyl sulfate. Quasoft 230, one preferred debonder available from Quaker Chemical Corp., contains an imidazolinium prepared by using oleic acid as the fatty acid. Debonders are preferably incorporated into the pulp prior to formation of the web. The pulp preferably contains from about 1 to about 20 lbs/ton, more preferably from about 1 to about 16 lbs/ton of debonder, still more preferably 2 to 16, still more preferably from about 5 to about 10 lbs/ton, and most preferably from 3 to 17.

When the debonder is added a softener may also be added. While the chemicals that constitute softeners and debonders may overlap, for the purposes of the present invention, a debonder is added to reduce the inter-fiber bonding in the paper web. A softener is added to change the surface characteristics of the fibers to thereby change the tactile impression given when the paper web is touched.

Suitable softeners include amido amine salts derived from partially acid neutralized amines. Such materials are disclosed in U.S. Pat. No. 4,720,383. Also relevant are the following articles: Evans, Chemistry and Industry, 5 Jul. 1969, Pp. 893-903; Egan, *J. Am. Oil Chemist's Soc.,* Vol. 55 (1978), Pp. 118-121; and Trivedi et al., *J. Am. Oil Chemist's Soc.,* June 1981, Pp. 754-756. All of the above are herein incorporated by reference in their entirety. As indicated therein, softeners are often available commercially only as complex mixtures rather than as single compounds. While this discussion will focus on the predominant species, it should be understood that commercially available mixtures would generally be used in practice.

Quasoft® 230 or Quasoft 218 may be used as softeners according to the present invention. Quasoft 218 is a suitable softener material which may be derived by alkylating a condensation product of oleic acid and diethylenetriamine. Synthesis conditions using a deficiency of alkylation agent (e.g., diethyl sulfate) and only one alkylating step, followed by pH adjustment to protonate the non-ethylated species, result in a mixture consisting of cationic ethylated and cationic non-ethylated species. A minor proportion (e.g., about 10%) of the resulting amido amines cyclize to imidazoline compounds. Since only the imidazoline portions of these material are quaternary ammonium compounds, the compositions as a whole are pH-sensitive. Therefore, in the practice of the present invention, particularly if Quasoft 218 is used, the pH in the headbox should be approximately 6 to 8, more preferably 6 to 7 and most preferably 6.5 to 7. When using Quasoft 230, pH dependence is reduced.

Quaternary ammonium compounds, such as dialkyl dimethyl quaternary ammonium salts are also suitable particularly when the alkyl groups contain from about 14 to 20 carbon atoms. These compounds have the advantage of being relatively insensitive to pH.

Biodegradable softeners can be utilized. Representative biodegradable cationic softeners/debonders are disclosed in U.S. Pat. Nos. 5,312,522; 5,415,737; 5,262,007; 5,264,082; and 5,223,096. All of which are incorporated herein by reference in their entirety. These compounds are biodegradable diesters of quaternary ammonia compounds, quaternized amine-esters, biodegradable vegetable oil based esters functional with quaternary ammonium chloride and diester dierucyldimethyl ammonium chloride and are representative biodegradable softeners. When it is present, the pulp preferably contains from about 0 to about 10 lbs/ton, more preferably from about 0 to about 6 lbs/ton of softener, most preferably 0 to 3 lbs/ton.

A softener may also be added to the web after formation by spraying. A spray softener may be used in conjunction with a wet end softener or in place of a wet end softener. If sprayed, the softener is preferably added in an amount of from about 0 to about 10 lbs/ton, more preferably from about 0 to about 6 lbs/ton of softener, most preferably 0 to 4 lbs/ton.

In the production of towels and napkins wet-strength-adjusting agents are often added. Suitable wet-strength-adjusting agents include cationic thermally-cured materials. A non-exhaustive list of cationic materials includes polyamide epihalohydrin (for example, resins marketed by Georgia Pacific Resins, Inc. under the tradename AMRES or by Borden under the tradename CASCAMID), glyoxylated cationic polyacrylamides (for example, resins marketed by Cytec Industries, Inc under the tradename PAREZ), polyacrylamide, polyethylenimine, polyDADMAC, alkaline-curing wet strength resins, urea formaldehyde, acid-curing wet strength resins, and melamine-formaldehyde, acid-curing wet strength resins. A reasonably comprehensive list of cationic wet strength resins that may be used is described by Westfelt in *Cellulose Chemistry and Technology,* Volume 13, p. 813, 1979, which is incorporated herein by reference.

Thermosetting cationic polyamide resins, useful in the present invention as wet-strength-adjusting agents, are reaction products of an epihalohydrin and a water soluble polyamide having secondary anionic groups derived from polyalkylene polyamine and saturated aliphatic dibasic carboxylic acids containing from 3 to 10 carbon atoms. These materials are relatively low-molecular-weight polymers having reactive functional groups such as amino, epoxy, and azetidinium groups. Description of processes for making such materials are included in U.S. Pat. Nos. 3,700,623 and 3,772,076, both to Keim and incorporated herein by reference in their entirety. A more extensive description of polymeric-epihalohydrin resins is given in Chapter 2: *Alkaline—Curing Polymeric Amine-Epichlorohydrin* by Espy in *Wet-Strength Resins and Their Application* (L. Chan, Editor, 1994), herein incorporated by reference in its entirety. The resins described in this article fall within the scope and spirit of the present invention. Polyamide-epichlorohydrin resins are commercially available under the tradename KYMENE® from Hercules Incorporated and CASCAMID® from Borden Chemical Inc.

Thermosetting polyacrylamides, also appropriate for use as wet-strength-adjusting agents, are produced by reacting acrylamide with diallyl dimethyl ammonium chloride (DADMAC) to produce a cationic polyacrylamide copolymer which is ultimately reacted with glyoxal to produce a cationic cross-linking wet strength resin, glyoxylated polyacrylamide. These materials are generally described in U.S. Pat. No. 3,556,932 to Coscia et al. and U.S. Pat. No. 3,556,933 to Williams et al., both of which are incorporated herein by reference in their entirety. Resins of this type are commercially available under the tradename of PAREZ by Cytec Industries. Different mole ratios of acrylamide/DADMAC/glyoxal can be used to produce cross-linking resins which are useful in the present invention. Furthermore, other dialdehydes can be substituted for glyoxal. Wet-strength-adjusting agents are preferably added in an amount of from about 4 to about 30 lbs/ton, more preferably from about 4 to about 25 lbs/ton, most preferably from about 6 to about 14 lbs/ton.

Surprisingly, it appears that in the production of towels and napkins the efficiency of the wet-strength-adjusting agent is increased through the combined use of a charge modifier and a retention aid.

Auxiliary agents that can be added to improve wet-strength properties in towels and napkins according to the present invention include carboxymethyl cellulose or an anionic copolymer of acrylamide-acrylate, for example, ACCOSTRENGTH 85 from Cytec Industries, Inc. or AMBOND 1500 from Georgia-Pacific Resins, Inc. The manipulation of the relative amounts of wet-strength-adjusting agents and auxiliary agents is well understood by the skilled artisan. Auxiliary agents are preferably added in an amount of from about 0 to about 10 lbs/ton, more preferably from about 1 to about 8 lbs/ton, most preferably from about 2 to about 5 lbs/ton.

A retention aid is also added to the furnish to form the product according to the present invention. Retention aids refer to an additive used to increase the retention of the ash and fines within the web during the papermaking process. Retention aids are discussed, for example, in J. E. Unbehend and K. W. Britt, "Pulp and Paper, Chemistry and Chemical Technology," Chapter 17, *Retention Chemistry, Ed.* 3, Vol. 3, Wiley Interscience publications and Chapter 18 of Kirk Othmer entitled Encyclopedia of Chemical Technology, 4th ed, both of which are incorporated herein by reference in their entirety. Suitable retention aids will be readily apparent to the skilled artisan.

Retention systems suitable for the manufacture of tissue of this invention involve bridging or networking of particles through oppositely charged high molecular weight macromolecules. Alternatively, the bridging is accomplished by employing dual polymer systems. Macromolecules useful for the single additive approach are cationic polyacrylamide such as, for example, poly(acrylamide)-co-diallyldimethyl ammonium chloride; poly(acrylamide)-co-acryloyloxyethyl trimethylammonium chloride, cationic gums, chitosan, cationic polyacrylates, and cationic starches (both amylase and amylopectin). Natural macromolecules such as, for example, starches and gums, are rendered cationic usually by treating them with 2,3-epoxypropyltrimethylammonium chloride, but other compounds can be used such as, for example, 2-chloroethyl-dialkylamine, acryloyloxyethyidialkyl ammonium chloride, acrylamidoethyltrialkylammonium chloride, etc. Dual additives useful for the dual polymer approach are any of those compounds which function as coagulants plus a high molecular weight anionic macromolecule such as, for example, anionic starches, CMC(carboxymethylcellulose), anionic gums, anionic polyacrylamides (e.g., poly(acrylamide)-co-acrylic acid), or a finely dispersed colloidal particle (e.g., colloidal silica, colloidal alumina, bentonite clay, or polymer micro particles marketed by Cytec Industries, Inc. under the tradename POLYFLEX).

Suitable cationic monomers for use as retention aids according to the present invention include dialkyl amino alkyl-(meth)acrylates or -(meth)acrylamides, either as acid salts or quaternary ammonium salts. Suitable alkyl groups include dialkylaminoethyl(meth)acrylates, dialkylaminoethyl(meth)acrylamides and dialkylaminomethyl(meth)acrylamides and dialkylamino-1,3-propyl(meth)acrylamides. These cationic monomers may be copolymerized with a nonionic monomer, preferably acrylamide. Other suitable polymers are polyethylene imines, polyamide epichlorhydrin polymers, and homopolymers or copolymers, generally with acrylamide, of monomers such as diallyl dimethyl ammonium chloride. The retention aid is preferably a substantially linear polymer when compared with the globular structure of, for example, starch.

Natural macromolecules such as, for example, cellulose, starch and gums are typically rendered anionic by treating them with chloroacetic acid, but other methods such as phosphorylation can be employed. Suitable retention agents are nitrogen containing organic polymers having molecular weights of about one hundred thousand to about thirty million. Suitable high molecular weight polymers are polyacrylamides, anionic acrylamide-acrylate polymers, cationic acrylamide copolymers having molecular weights of about one million to about thirty million and polyethyleneimines having molecular weights in the range of about five hundred thousand to about two million.

Another mechanism by which the fines/ash are retained in the paper product according to the present invention is entrapment. This is the mechanical entrapment of particles in the fiber network. Entrapment is suitably achieved by maximizing network formation such as by forming the networks in the presence of high molecular weight anionic polyacrylamides, or high molecular weight polyethyleneoxides (PEO), such as, Polyox WSR 301 from Union Carbide. Alternatively, molecular nets are formed in the network by the reaction of dual additives such as, for example, PEO and phenolic resin.

Useful charge densities include those between about 0.2 and about 15 equivalents per kilogram of polymer, more preferably between about 0.2 and about 10, most preferably between about 0.5 and about 5 equivalents per kilogram of polymer.

Preferred polymers according to the present invention have molecular weights of at least about 1,000,000, more preferably at least about 4,000,000, and most preferably between about 5,000,000 and about 25,000,000.

Commercially available, suitable, retention aids include Reten 1232® and Microform 2321®, both emulsion polymerized cationic polyacrylamides and Reten 157®, which is delivered as a solid granule; all are products of Hercules, Inc. Other suitable products include Accurac 91 from Cytec Industries, Inc, 7520 from Nalco Chemical Co., or Bufloc 594 or Bufloc 606 from Buckman Laboratories, Inc.

Improvements in the areas of filler retention have been achieved using combinations of retention aids, for example a low-molecular-weight cationic polymer with a high molecular weight anionic polymer. Thus, according to the present invention, it is possible to use combinations of known retention aids, often called coagulants, retention aids or flocculants to achieve suitable retention of the ash and fines within the soft absorbent paper product according to the present invention.

The retention aid can be added at any suitable point in the approach flow of the furnish preparation system of the papermaking process. It is preferred that the retention aid be added after the fan pump and immediately prior to the furnish being delivered to the forming wire. It is preferred to add the retention aid after as much of the furnish processing involving shear, as is practical, has been completed.

The retention aid is preferably diluted to a consistency below about 0.5% solids and can be present in amounts as low at 0.005%, more preferably below about 0.3%, still more preferably below about 0.1%, most preferably between about 0.05% and 0.2%. The retention aid is delivered to the process as an aqueous dispersion. Because of the relatively high molecular weight of most retention aids, the solids content of the dispersion should be kept as low as possible.

Whether the retention aid is of an anionic or cationic type, it will be delivered to the system as an aqueous emulsion, dispersion, or solution at comparable concentrations and overall usage rates.

The retention aid is incorporated into the furnish in an amount of from about 0.1 to about 4 lbs/ton, more preferably from about 0.3 to about 2 lbs/ton, most preferably about 0.5-1.5 lbs/ton.

It has been surprisingly discovered that when using the above described chemistries, if one maximizes the amount of water flow through these high ash furnishes, i.e., minimizes the consistency of the furnish, the nascent web can be formed with better profiles and higher internal void volumes. The consistency of the furnish should be less than about 0.9%, more preferably less than about 0.7% and most preferably, the furnish consistency should be less than about 0.5%. As used in the present application consistency includes total suspended solids present within the furnish. Consistency can be determined according to TAPPI method T240 om-93, modified to use a medium filter paper, e.g., Whatman #3 to improve capture of all finely divided solids. The use of excess water is contrary to the common practice in the art when using high ash containing furnishes. Typically, when excess water is used with a high ash furnish, the fines and ash tend to be washed out of the web thereby leaving a thin and inconsistent formation profile. Also, excess water can overwhelm the former resulting not only in poor formation, but also in reduced production speed due to flooding.

Other chemicals can be added to the papermaking slurry including, but not limited to, formation aids, drainage aids, defoamers, wet strength additives, pitch control agents, slimicides and biocides, creping agents, absorbency aids, dry strength additives and dyes. Appropriate agents will be readily understood by the skilled artisan.

After all chemicals are added to the furnish, it is delivered to the former where a nascent web is formed. Once the nascent web is formed, it can be dried using any technique known to the skilled artisan. Such drying techniques include compactive dewatering followed by drying on a Yankee dryer; through-air drying with or without drying on a Yankee dryer; wet creping from a Yankee dryer followed by can drying or TAD; and impulse drying with or without a Yankee dryer. The products according to the present invention are preferably made by conventional wet pressing and creping from a Yankee dryer.

In a preferred embodiment of the present invention, the product is a creped product. This means that the product, regardless of the initial drying method is adhered to and creped from a Yankee dryer. Any suitable art recognized adhesive may be used on the Yankee dryer. Preferred adhesives include polyvinyl alcohol with suitable plasticizers, glyoxylated polyacrylamide with or without polyvinyl alcohol, and polyamide epichlorohydrin resins such as Quacoat A-252 (QA252), Betzcreplus 97 (Betz+97) and Calgon 675 B. Other preferred adhesives include polyamineamide-epichlorhydrin resins such as Solvox 4450 and Houghton 82-213. Suitable adhesives are widely described in the patent literature. A comprehensive but non-exhaustive list includes U.S. Pat. Nos. 5,246,544; 4,304,625; 4,064,213; 3,926,716; 4,501,640; 4,528,316; 4,788,243; 4,883,564; 4,684,439; 5,326,434; 4,886,579; 5,374,334; 4,440,898; 5,382,323; 4,094,718; 5,025,046; and 5,281,307.

Typical release agents can be used in accordance with the present invention. Release agents appropriate for use with the present invention include Solvox 5309, Solvox Manufacturing. Typical release agents are complex mixtures of hydrocarbon oils and surfactants. Other release agents are Prosoft TR-8630 from Betz Dearborn; Houghton 565 and Houghton 8302, both from Houghton International; and R-253 from Quaker Chemical Corp.

Typical coating modifiers can be used in accordance with the present invention. Coating modifiers are typically polyvinyl alcohols, polyols, such as sorbitol, quaternized polyamido amines, or polyvinyl acetate latexes. Coating modifiers appropriate for use with the present invention include polyamido amines such as, Quaker 2008.

Creping of the paper from the Yankee dryer is carried out at a moisture content preferably below about 50%, more preferably below about 15%, and still more preferably below about 6%.

In a more preferred embodiment, creping of the paper from the Yankee dryer is carried out using an undulatory creping blade, such as that disclosed in U.S. Pat. No. 5,690,788, (hereinafter "the patented undulatory blade") which is herein incorporated by reference. Use of the undulatory crepe blade has been shown to impart several advantages when used in production of tissue products made primarily or entirely from recycled fibers. In general, tissue products creped using an undulatory blade have higher caliper (thickness), increased CD stretch, and a higher void volume than do comparable tissue products produced using conventional crepe blades. All of these changes effected by use of the undulatory blade tend to correlate with improved softness perception of the tissue products.

Figure 6B:
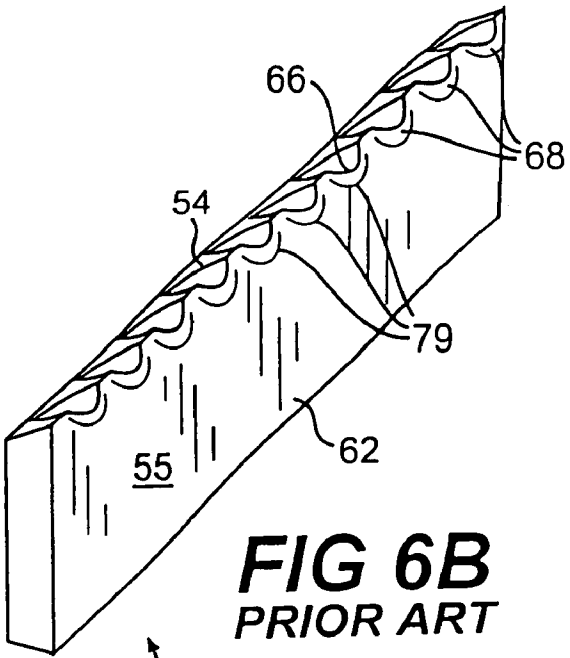
FIG 6B PRIOR ART
FIGS. 6A, 6B, and 6C illustrate perspective views of an undulatory creping blade of the patented undulatory blade used in producing the absorbent product of the present invention.
Figure 6C:
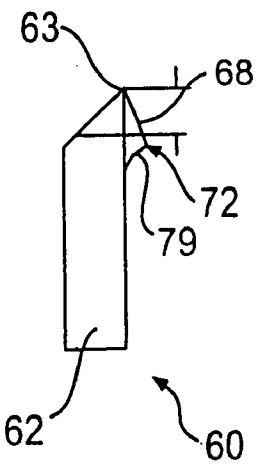
FIG 6C PRIOR ART
Figure 6A:
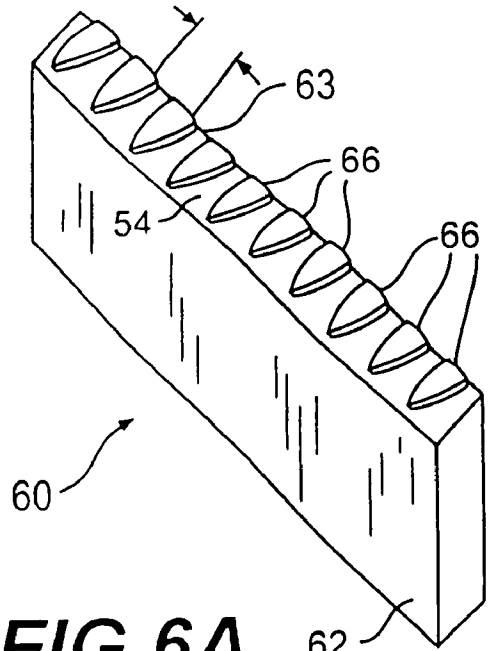
FIG 6A PRIOR ART

Another effect of using the undulatory blade is that there is a greater drop in sheet tensile strength during the creping operation than occurs when a standard creping blade is used. This drop in strength, which also improves product softness, is particularly beneficial when tissue base sheets having relatively high basis weights (>9 lbs/ream) or containing substantial amounts of recycled fiber are produced. Such products often have higher-than-desired strength levels, which negatively affect softness. In sheets including high levels of a recycled fiber, a reduction in strength equivalent to that caused by use of an undulatory crepe blade can only be effected, if at all, by application of extremely high levels of chemical debonders. These high debonder levels, in addition to increasing product cost, can also result in problems such as loss of adhesion between the sheet and the Yankee dryer, which adversely impacts sheet softness, runnability, felt filling, and formation of deposits in stock lines and chests. FIGS. 6A and 6B illustrate a portion of a preferred undulatory creping blade 60 of the patented undulatory blade usable in the practice of the present invention in which the body 62 extends indefinitely in length, typically exceeding 100 inches in length and often reaching over 26 feet in length to correspond to the width of the Yankee dryer on the larger modern paper machines. Flexible blades of the patented undulatory blade having indefinite length can suitably be placed on a spool and used on machines employing a continuous creping system. In such cases the blade length would be several times the width of the Yankee dryer. In contrast, the width of the body 62 of the blade 60 is usually on the order of several inches while the thickness of the body 62 is usually on the order of fractions of an inch.

Figure 7:
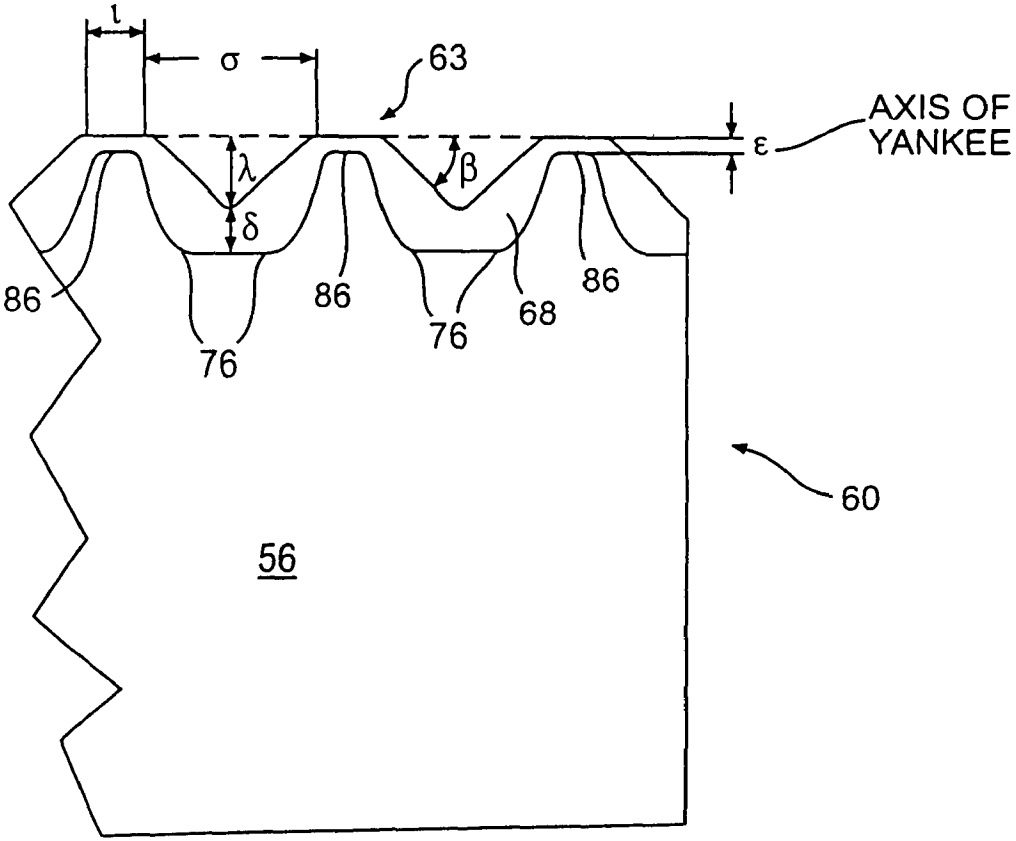
FIG. 7 (PRIOR ART)
FIG. 7 schematically illustrates the contact region defined between the patented undulatory blade for use in the present invention and the Yankee.
Figure 9C:
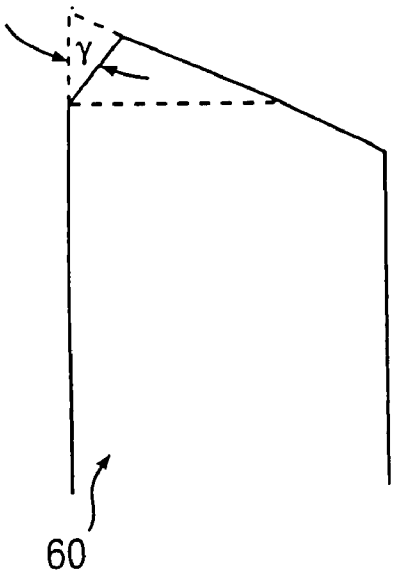
FIG. 9C (PRIOR ART)
FIG. 9C illustrates a reversed relieved undulatory creping blade.
Figure 9B:
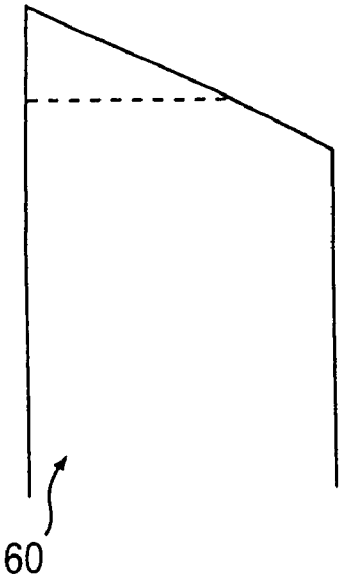
FIG. 9B (PRIOR ART)
FIG. 9B illustrates a flush dressed undulatory creping blade for use in the present invention and the Yankee.
Figure 9A:
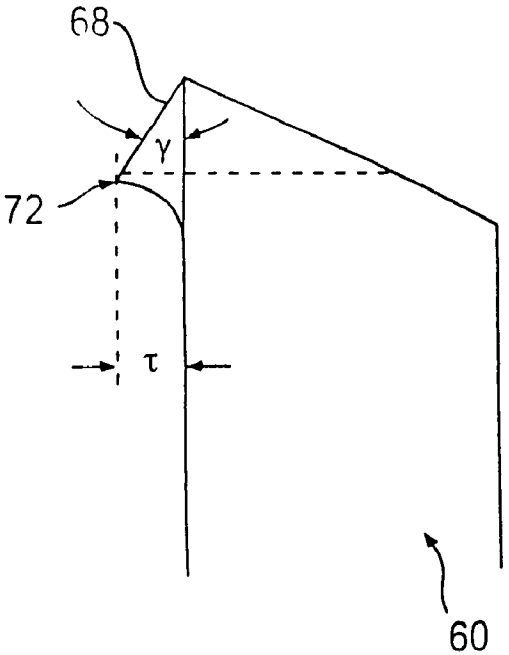
FIG. 9A (PRIOR ART)
FIG. 9A illustrates an undulatory creping blade wherein the Yankee-side of the patented undulatory blade has been beveled at an angle equal to that of the creping bade or holder angle.
Figure 10:
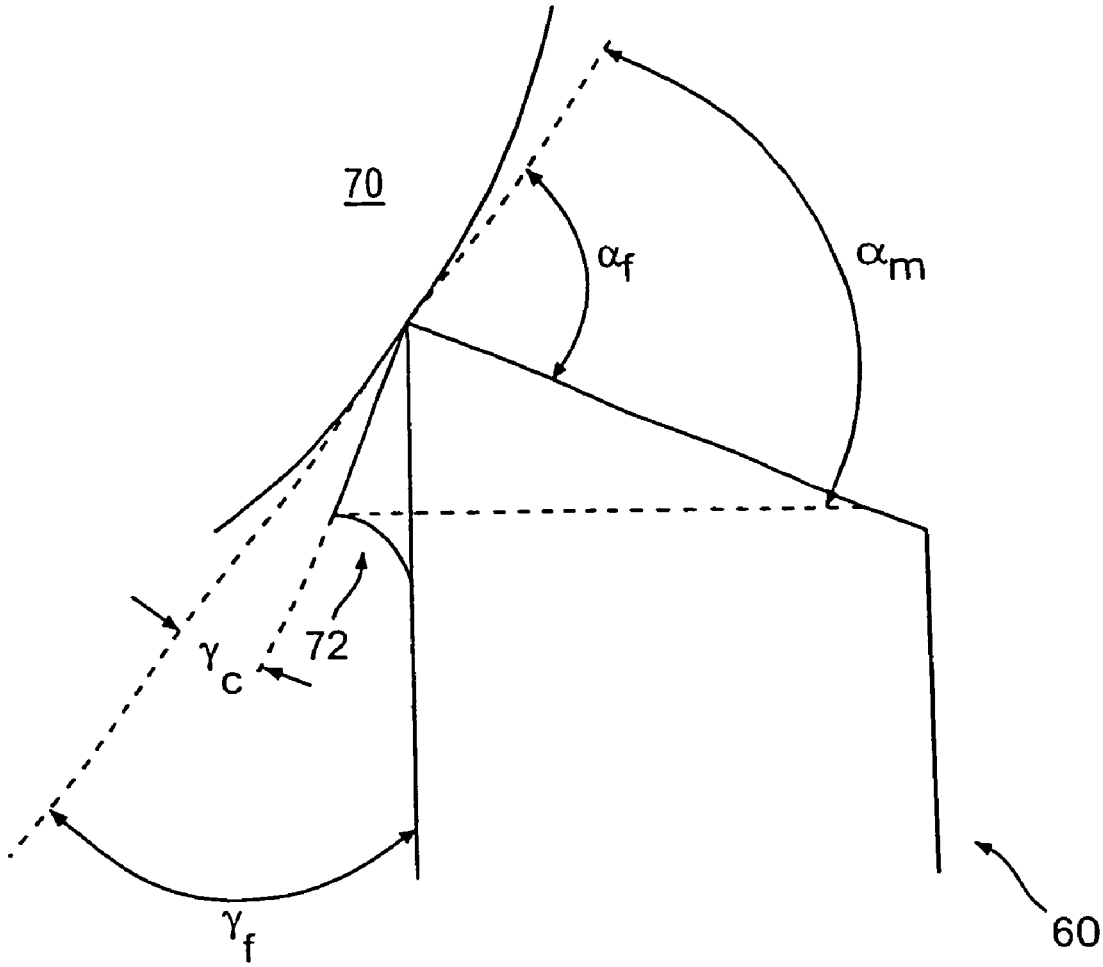
FIG. 10 (PRIOR ART)
FIG. 10 shows the creping process geometry and illustrates the nomenclature used to define angles herein.
Figure 12:
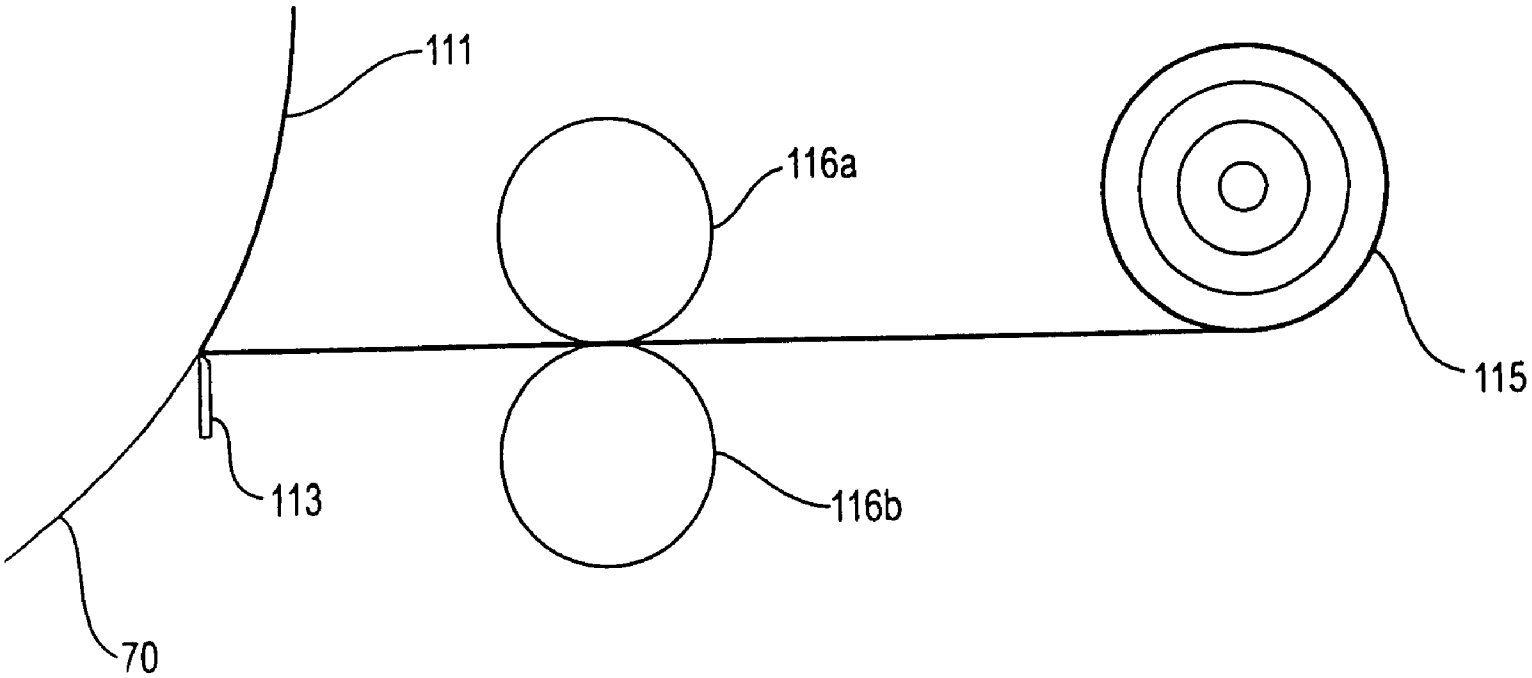
FIG. 12 (PRIOR ART)
FIG. 12 illustrates a dry crepe process.
Figure 13:
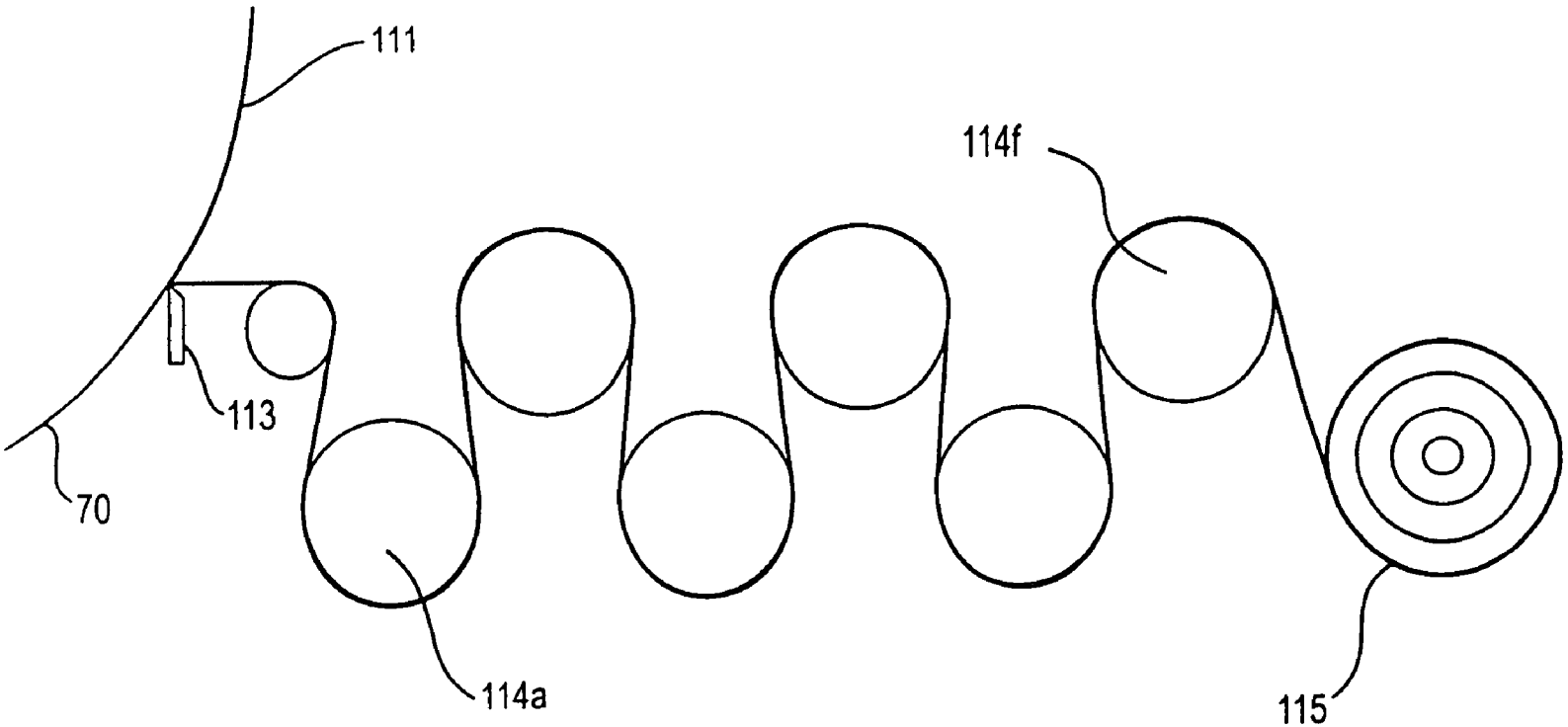
FIG. 13 (PRIOR ART)
FIG. 13 illustrates a wet crepe process.

As illustrated in FIGS. 6A and 6B, an undulatory cutting edge 63 of the patented undulatory blade is defined by serrulations 66 disposed along, and formed in, one edge of the body 62 so that the undulatory engagement surface 68, schematically illustrated in more detail in FIGS. 7, 9 and 10, disposed between the rake surface 54 and the relief surface 56, engages the Yankee 70 during use, as shown in FIGS. 10, 12, and 13. Although a definitive explanation of the relative contribution of each aspect of the geometry is not yet available, it appears that four aspects of the geometry have predominant importance. In the most preferred blades 60 of the patented undulatory blade, four key distinctions are observable between these most preferred blades and conventional blades: the shape of the engagement surface 68, the shape of the relief surface 56, the shape of the rake surface 54, and the shape of the actual undulatory cutting edge 63. The geometry of engagement surface appears to be associated with increased stability as is the relief geometry. The shape of the undulatory cutting edge 63 of the patented undulatory blade appears to strongly influence the configuration of the creped web, while the shape of the rake surface 54 is thought to reinforce this influence.

It appears that improved stability of the creping operation is associated with presence of the combination of: (i) the undulatory engagement surface 68 having increased engagement area; and (ii) the foot 72, as shown in FIG. 6C, defined in the relief surface 56 and providing a much higher degree of relief than is usually encountered in conventional creping. This is illustrated in FIGS. 9A, 9B, and 9C. FIG. 9A illustrates a preferred blade of the patented undulatory blade, wherein, as shown in FIG. 10, the beveled area engages the surface of the Yankee 70 in surface-to-surface contact. In FIG. 9B, the foot 72 is dressed away so that the Yankee-side of the blade 60 is flat and the blade 60 engages the surface of the Yankee 70, as shown in FIG. 10, in line-to-surface contact. In FIG. 9C, not only has the Yankee-side foot 72 been removed but the Yankee-side of the blade 60 has been beveled at an angle equal to blade angle $\gamma_1$ as defined in FIG. 10. It appears that combinations of the four primary features greatly increase the beneficial results of use of the preferred undulatory blades 60 of the patented undulatory blade as used in the manufacture of absorbent paper products of this invention.

It is also hypothesized that hardening of the blade due to cold working during the knurling process may contribute to improved wear life. Microhardness of the steel at the root of a serrulation can show an increase of 3-5 points on the Rockwell 'C' scale. This increase is believed to be insufficient to significantly increase the degree of wear experienced by the Yankee, but may increase blade life.

It appears that the biaxially undulatory geometry of the creped web is largely associated with presence of: (i) the undulatory rake surface 54, as shown in FIG. 6B; and (ii) the undulatory cutting edge 63, as shown in FIG. 6C, which both exert a shaping and bulking influence on the creped web.

Figure 8A:
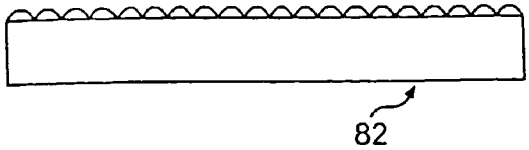
FIG. 8A (PRIOR ART)
FIGS. 8A-G illustrate various elevational view of an undulatory creping blade for use in the present invention.
Figure 8B:
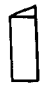
FIG. 8B (PRIOR ART)
Figure 8C:
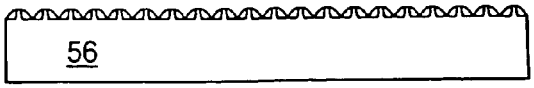
FIG. 8C (PRIOR ART)
Figure 8D:
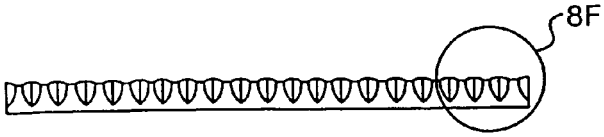
FIG. 8D (PRIOR ART)
Figure 8E:
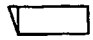
FIG. 8E (PRIOR ART)
Figure 8F:
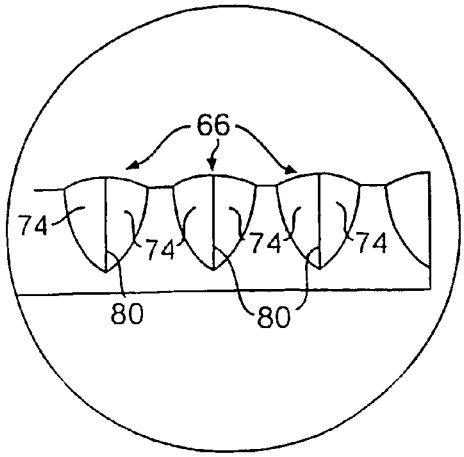
FIG. 8F (PRIOR ART)
Figure 8G:
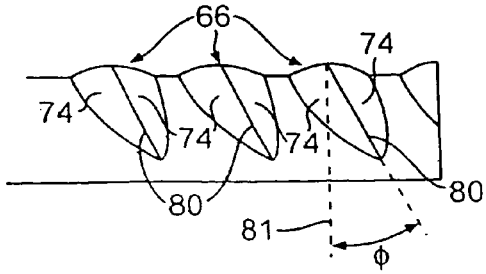
FIG. 8G (PRIOR ART)
Figure 16:
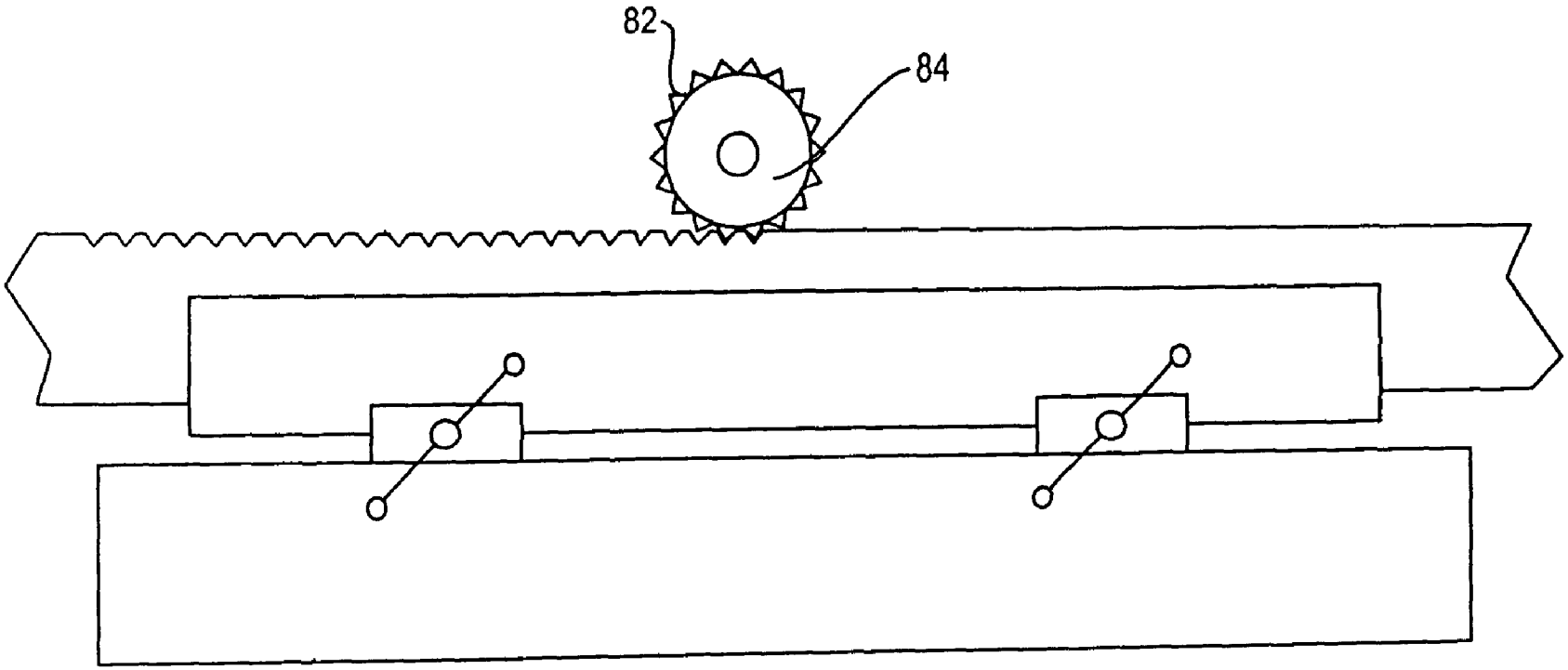
FIG. 16 (PRIOR ART)
FIG. 16 illustrates a process for manufacture of the patented undulatory blade.

When the most preferred undulatory creping blades of the patented undulatory blade are formed as shown in FIGS. 6A, 6B, and 6C, and as shown in detail in FIGS. 7, 8F, and 8G, each serrulation 66 results in the formation of indented undulatory rake surfaces 74, nearly planar crescent-shaped bands 76, as shown in FIG. 7, foot 72, and protruding relief surface 79, as shown in FIG. 6C. In FIGS. 8F and 8G, each undulation is shown resulting in two indented undulatory rake surfaces 74 separated by a dividing surface 80 corresponding to an edge 82 as defined in the FIG. 16 knurling tool 84. While the presence of the dividing surface 80 makes it easy to visualize the nature of the indented undulatory rake surface 74, there is no requirement that these surfaces be discontinuous and, indeed, it is expected that, as the knurling tool 84 is used repeatedly, the edge 82 will become blunted resulting in a single continuous indented undulatory rake surface 74. In our experience, either type of indented undulatory rake surface 74 is suitable. As illustrated best in FIG. 7, the undulatory engagement surface 68 consists of a plurality of substantially co-linear rectilinear elongate regions 86 of width $\epsilon$, and length "l" interconnected by nearly planar crescent-shaped bands 76 of width $\delta$, depth $\lambda$, and span $\sigma$. As seen best in FIGS. 6B and 6C of the patented undulatory blade, each nearly planar crescent-shaped band 76 (shown in FIG. 7) defines one surface of each relieved foot 72 projecting out of the relief surface 56 of the body 62 of the blade 60. We have found that, for best results, certain of the dimensions of the respective elements defining the undulatory engagement surface 68, i.e., the substantially co-linear rectilinear elongate regions 86 and the nearly planar crescent-shaped bands 76, both shown in FIG. 7, are preferred. In particular, as shown in FIG. 7, the width $\epsilon$ of the substantially co-linear rectilinear elongate regions 86 is preferably substantially less than the width $\delta$ of the nearly planar crescent-shaped bands 76, at least in a new blade. In preferred embodiments of the patented undulatory blade used to manufacture the absorbent paper products of this invention, the length "l" of the substantially co-linear rectilinear elongate regions 86 should be from about 0.002" to about 0.084". For most applications, "l" will be less than 0.05". The depth $\lambda$ of the serrulations 66 in the patented undulatory blade should be from about 0.008" to about 0.050"; more preferably from about 0.010" to about 0.035" and most preferably from about 0.015" to about 0.030", and the span o of the nearly planar crescent-shaped bands 76 should be from about 0.01" to about 0.095"; more preferably from about 0.02" to about 0.08" and most preferably from about 0.03" to about 0.06". Blades having a discontinuous undulatory engagement surface 68 can also be used. This can happen if the blade 60 is tilted in one of two ways: first, the undulatory engagement surface may consist only of substantially co-linear elongate regions 86 or possibly a combination of substantially co-linear elongate regions 86 and the upper portions of crescent-shaped bands 76 if blade 60 is tilted away from the Yankee 70; or second, the undulatory engagement surface may consist of the lower portions of the crescent-shaped bands 76 if the blade 60 is tilted inwardly with respect to the Yankee 70. Both of these configurations do run stably and, in fact, have run satisfactorily for extended periods.

Several angles must be defined in order to describe the geometry of the cutting edge of the undulatory blade of the patented undulatory blade used in the manufacture of the absorbent paper of this invention. To that end, we prefer to use the following terms:

creping angle "$\alpha$"—the angle between the rake surface 54 of the blade 60 and the plane tangent to the Yankee 70 at the point of intersection between the undulatory cutting edge 63 and the Yankee 70;

axial rake angle "β"—the angle between the axis of the Yankee 70 and the undulatory cutting edge 63 which is, of course, the curve defined by the intersection of the surface of the Yankee 70 with indented rake surface 74 of the blade 60;

relief angle "γ"—the angle between the relief surface 56 of the blade 60 and the plane tangent to the Yankee 70 at the intersection between the Yankee 70 and the undulatory cutting edge 63, the relief angle measured along the flat portions of the present blade is equal to what is commonly called "blade angle" or "holder angle"; and side rake angle "φ"—, shown in FIG. 8—the angle between the line 80 and the normal to the Yankee 70 in the plane defined by the normal to the Yankee at the points of contact in with the cutting edge of the blade (line 23, FIGS. 6 and 8) and the axis of the Yankee dryer 81. The Yankee 70 is shown in FIG. 11.

Quite obviously, the value of each of these angles will vary depending upon the precise location along the cutting edge at which it is to be determined. We believe that the remarkable results achieved with the undulatory blades of the patented undulatory blade in the manufacture of the absorbent paper products of this invention are due to those variations in these angles along the cutting edge. Accordingly, in many cases it will be convenient to denote the location at which each of these angles is determined by a subscript attached to the basic symbol for that angle. We prefer to use the subscripts "f", "c" and "m" to indicate angles measured at the rectilinear elongate regions, at the crescent shaped regions, and the minima of the cutting edge, respectively. Accordingly, "$\gamma_f$", the relief angle measured along the flat portions of the present blade, is equal to what is commonly called "blade angle" or "holder angle".

Figure 11B:
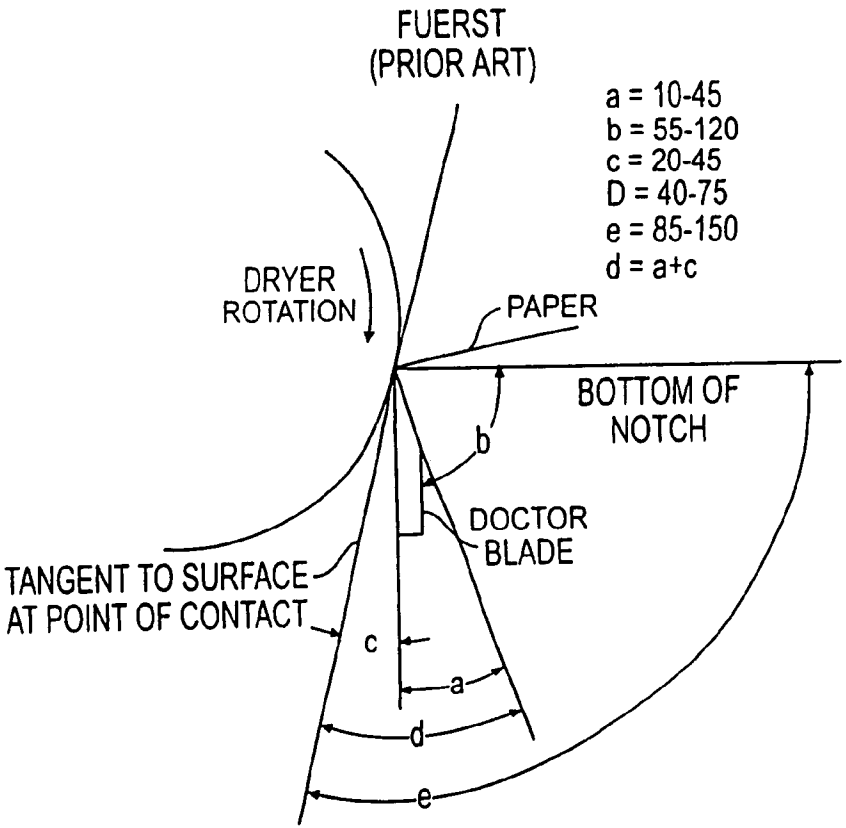
FIG. 11B (PRIOR ART)
FIGS. 11A and 11B contrast the creping geometry of the patented undulatory blade with that of the blade disclosed in Fuerst, U.S. Pat. No. 3,507,745.
Figure 11A:
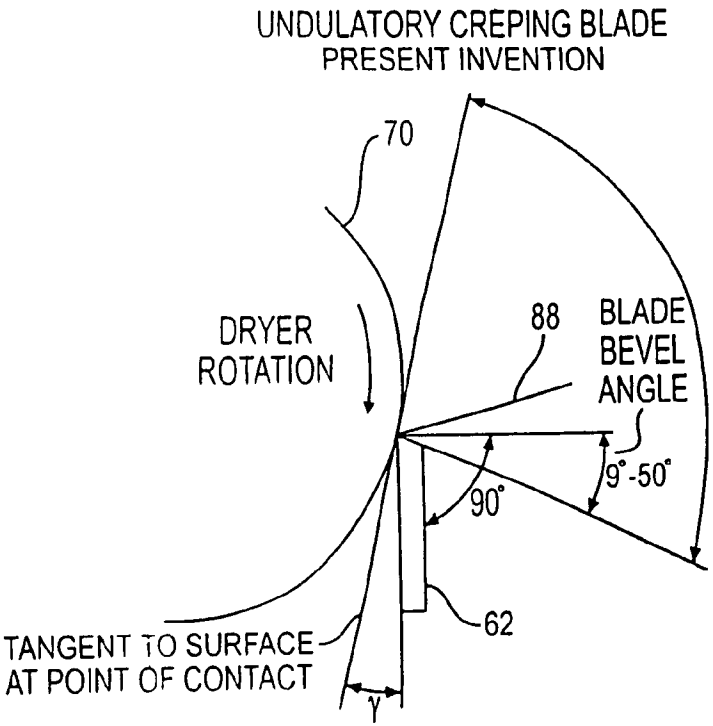
FIG. 11A (PRIOR ART)

For example, as illustrated in FIGS. 10 and 11, the local creping angle "α" of the patented undulatory blade is defined at each location along the undulatory cutting edge 63 as being the angle between the rake surface 54 of the blade 60 and the plane tangent to the Yankee 70. Accordingly, it can be appreciated that as shown in FIGS. 10 and 11, "$\alpha_f$", the local creping angle adjacent to the substantially co-linear rectilinear elongate regions 86 (shown in FIG. 7) is usually higher than "$\alpha_c$", the local creping angle adjacent to the nearly planar crescent-shaped bands 76. Further, it can be appreciated that, as shown in FIGS. 7, 8, and 10 along the length of the nearly planar crescent-shaped bands 76, the local creping angle "$\alpha_c$" varies from higher values adjacent to each rectilinear elongate region 86 to lower values "$\alpha_m$" adjacent the lowest portion of each serrulation 66. Angle "$\alpha_c$", though not specifically labeled in FIG. 10 should be understood to be the creping angle measured at any point on the indented undulatory rake surface 74 (shown in FIG. 8). As such, it will have a value between "$\alpha_f$" and "$\alpha_m$". In preferred blades of the patented undulatory blade, the rake surface may generally be inclined, forming an included angle between 30° and 90° with respect to the relief surface, while "$\alpha_f$" will range from about 30° to about 135°, preferably from about 60° to about 135°, and more preferably from about 75° to about 125° and most preferably 85° to 115°; while "$\alpha_m$" will preferably range from about 15° to about 135°, and more preferably from about 25° to about 115°.

Similarly, as illustrated in FIG. 7, the local axial rake angle "β" defined at each location along the undulatory cutting edge 63. The angle is formed between the axis of the Yankee 70 and the curve defined by the intersection of the surface of the Yankee 70 with the indented rake surface 74 of the blade 60, otherwise known as undulatory cutting edge 63. Accordingly, it can be appreciated that the local axial rake angle along the substantially co-linear rectilinear elongate regions 86, "$\beta_f$", is substantially 0°, while the local axial rake angle along the nearly planar crescent-shaped bands 76, "$\beta_c$", varies from positive to negative along the length of each serrulation 66. Further, it can be appreciated that the absolute value of the local axial rake angle "$\beta_c$" varies from relatively high values adjacent to each rectilinear elongate region 86 to much lower values, approximately 0°, in the lowest portions of each serrulation 66. In preferred blades of the patented undulatory blade, "$\beta_c$" will range in absolute value from about 15° to about 75°, more preferably from about 20° to about 60°, and most preferably from about 25° to about 45°.

As discussed above and shown best in FIGS. 6A, 6B, and 6C, in the preferred blades of the patented undulatory blade for manufacture of the absorbent paper products of the present invention, each nearly planar crescent-shaped band 76 (shown in FIG. 7) intersects a protruding relief surface 79 of each relieved foot 72 projecting out of the relief surface 56 of the body 62 of the blade 60. While we have been able to operate the process of the patented undulatory blade with blades 60 not having a relieved foot 72, we have found that the presence of a substantial relief foot 72 makes the procedure much less temperamental and much more forgiving. We have found that for very light or weak sheets, the process often does not run easily without the foot. FIGS. 9A, 9B, and 9C illustrate the blade 60 with and without a foot 72. Normally, we prefer that the height "τ" of each relieved foot 72 be at least about 0.005" at the beginning of each operation. It appears that most stable creping continues for at least the time in which the relieved foot 72 has a height "τ" of at least about 0.002" and that, once the relieved foot 72 is entirely eroded, web 88 (shown in FIG. 15) becomes much more susceptible to tearing and perforations.

As illustrated in FIGS. 10 and 11, the local relief angle "γ" is defined at each location along the undulatory cutting edge 63 as being the angle between the relief surface 56 of the blade 60 and the plane tangent to the Yankee 70. Accordingly, it can be appreciated that "$\gamma_f$", the local relief angle having its apex at surface 63, is greater than or equal to "$\gamma_c$", the local relief angle adjacent to the nearly planar crescent-shaped bands 76. Further, it can be appreciated that the local relief angle "$\gamma_c$" varies from relatively high values adjacent to each rectilinear elongate region 86 to lower values close to 0° in the lowest portions of each serrulation 66. In preferred blades of the patented undulatory blade, "$\gamma_f$", will range from about 5° to about 60°, preferably from about 10° to about 45°, and more preferably from about 15° to about 30°, these values being substantially similar to those commonly used as "blade angle" or "holder angle" in conventional creping; while "$\gamma_c$" will be less than or equal to "$\gamma_f$", preferably less than 10° and more preferably approximately 0° if measured precisely at the undulatory cutting edge 63. However, even though the relief angle "$\gamma_c$" when measured precisely at undulatory cutting edge 63 is very small, it should be noted that relief surface 56, which is quite highly relieved, is spaced only slightly away from undulatory cutting edge 63.

In most cases, side rake angle "φ", defined above, is between about 0° and 45° and is "balanced" by another surface of mirror image configuration defining another opposing indented rake surface 74 as we normally prefer that the axis of symmetry of the serrulation be substantially normal to the relief surface 56 of the blade 60 as is shown in FIG. 8F. However, we have obtained desirable results when the serrulations are not "balanced" but rather are "skewed" as indicated in FIG. 8G.

The undulatory creping blade 60 of the patented undulatory blade used in the manufacture of the absorbent paper products of this invention comprises an elongated, relatively rigid, thin plate, the length of the plate being substantially greater than the width of the plate and the width of the plate being substantially greater than the thickness thereof, the plate having: an undulatory engagement surface formed therein along the length of an elongated edge thereof, the undulatory engagement surface being adaptable to be engaged against the surface of a Yankee drying cylinder, the undulatory engagement surface constituting a spaced plurality of nearly planar crescent-shaped bands of width "δ", depth "λ," and span "σ" interspersed with, and inter-connected by, a plurality of substantially co-linear rectilinear elongate regions of width "ϵ" and length "l", the initial width "ϵ" of the substantially rectilinear elongate regions being, substantially less than the initial width "δ" of the nearly planar crescent-shaped bands of the serrulated engagement surface.

In the undulatory creping blade, the creping angle, defined by the portion of each indented rake surface interspersed among the substantially co-linear rectilinear elongate regions, is between about 30° and 135°, the absolute value of the side rake angle "φ" being between about 0° and 45°.

In a preferred embodiment of the patented undulatory blade, the undulatory creping blade comprises an elongated, relatively rigid, thin plate, the length of the plate being substantially greater than the width of the plate and typically over 100 inches in length and the width of the plate being substantially greater than the thickness thereof, the plate having: a serrulated engagement surface formed therein along the length of an elongated edge thereof, the serrulated engagement surface being adaptable to be engaged against the surface of a Yankee drying cylinder, the serrulated engagement surface constituting a spaced plurality of nearly planar crescent-shaped bands of width "δ", depth "λ" and span "σ" interspersed with, and inter-connected by, a plurality of substantially co-linear rectilinear elongate regions of width "ϵ" and length "l," the initial width "ϵ" of the substantially rectilinear elongate regions being substantially less than the initial width "δ" of the nearly planar crescent-shaped bands of the serrulated engagement surface, a rake surface defined thereupon adjoining the serrulated engagement surface, extending across the thickness of the plate. A relief surface defined thereupon adjoining the serrulated engagement surface, the length "l" of each of the plurality of substantially co-linear rectilinear elongate regions being between about 0.0020" and 0.084", the span "σ" of each of said plurality of nearly planar crescent-shaped bands being between about 0.01" and 0.095, the depth "λ" of each of the plurality of nearly planar crescent-shaped bands being between about 0.008" and 0.05".

Advantageously, adjacent each of the relieved nearly planar crescent-shaped bands, a foot having a height of at least about 0.001" protrudes from the relief surface, the relief angle of the relieved nearly planar crescent-shaped bands being greater than the relief angle of substantially co-linear rectilinear elongate regions.

The advantages of using the undulatory creping blade process apply also to wet crepe and Through Air Drying (TAD) processes as well as to conventional dry crepe technology. The dry crepe process is illustrated in FIG. 12. In the process, tissue sheet 111 is creped from the Yankee dryer 70 using an undulatory creping blade 113. The moisture content of the sheet when it contacts the undulatory creping blade 113 is usually in the range of 2 to 8 percent. Optionally, the creped sheet may be calendered by passing it through calender rolls 116*a* and 116*b*, which impart smoothness to the sheet while reducing its thickness. After calendering, the sheet is wound onto the reel 115.

The wet crepe process is illustrated in FIG. 13. In the process, the tissue sheet 111 is creped from the Yankee dryer 70 using an undulatory creping blade 113 of the patented undulatory blade. The moisture content of the sheet contacting the undulatory creping blade 113 is usually in the range of 15 to 50 percent. After the creping operation, the drying process is completed by use of one or more steam-heated can dryers 114*a*-114*f*. These dryers are used to reduce the moisture content to its desired final level, usually from 2 to 8 percent. The completely dried sheet is then wound onto the reel 115.

Figure 14:
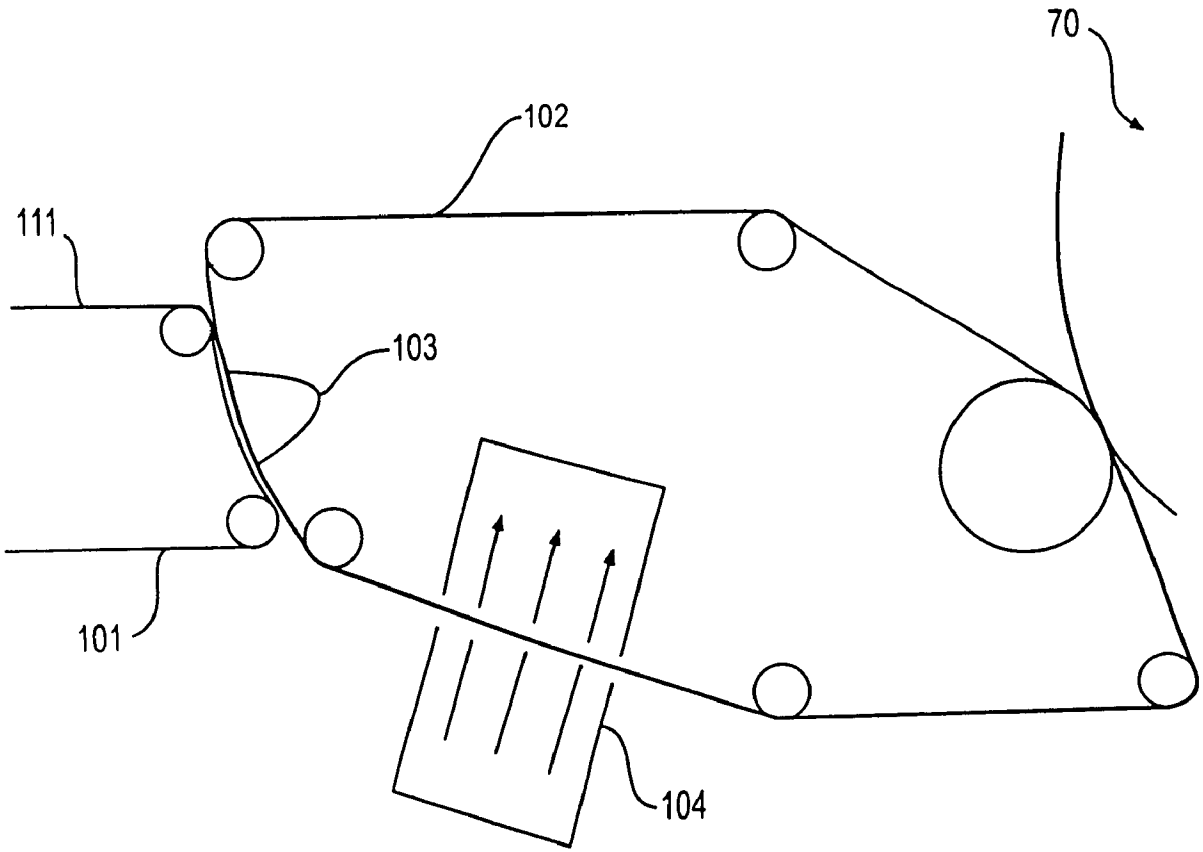
FIG. 14 (PRIOR ART)
FIG. 14 illustrates a TAD process.

The TAD process is illustrated in FIG. 14. In the process, wet sheet 111 that has been formed on forming fabric 101 is transferred to through-air-drying (TAD) fabric 102, usually by means of a vacuum device 103. TAD fabric 102 is usually a coarsely woven fabric that allows relatively free passage of air through both the fabric 102 and the nascent web 111. While on the fabric 102, the sheet 111 is dried by blowing hot air through the sheet 111 using a through-air-dryer 104. This operation reduces the sheet's moisture to a value usually between 10 and 65 percent. The partially dried sheet 111 is then transferred to the Yankee dryer 70 where it is dried to its final desired moisture content and is subsequently creped off the Yankee.

Figure 17:
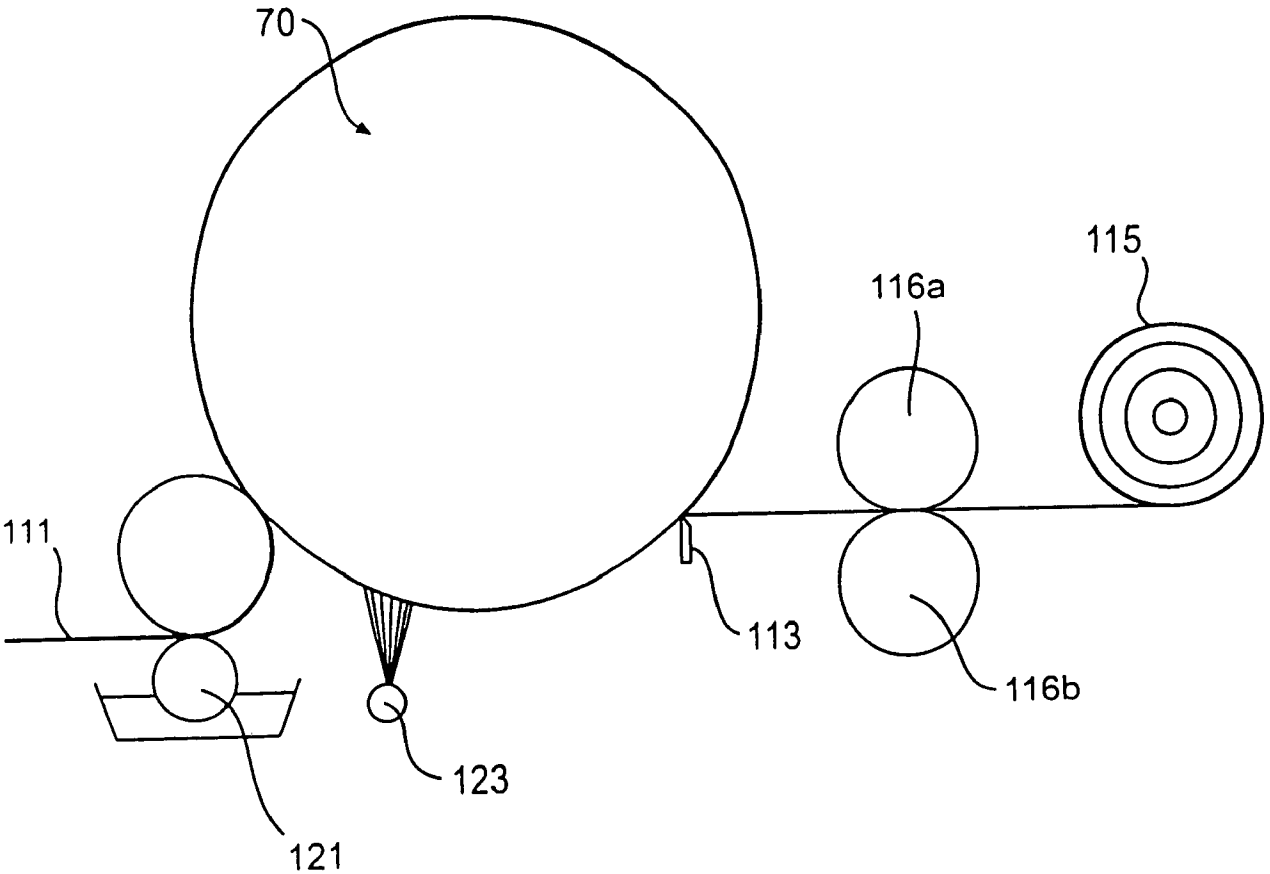
FIG. 17 (PRIOR ART)
FIG. 17 illustrates a recreped process.

Our process also includes an improved process for production of a double or a recreped sheet using the patented undulatory blade. In our process the once creped cellulosic web described above is adhered to the surface of a Yankee dryer. The moisture is reduced in the cellulosic web while in contact with the Yankee dryer and the web is recreped from the Yankee dryer. The recrepe process is shown in FIG. 17. In this process, adhesive is applied to either a substantially dried, creped web 111, Yankee/crepe dryer 70, or to both. The adhesive may be applied in any of a variety of ways, for example using a patterned applicator roll 121 as shown, an adhesive spray device 123, or using various combinations of applicators as are known to those skilled in the art. Moisture from the adhesive and possibly some residual moisture in the sheet are removed using the Yankee/crepe dryer 70. The sheet is then creped from the Yankee/crepe dryer 70 using a patented undulatory blade crepe blade 113, optionally calendered using calender rolls 116*a* and 116*b*, and wound onto the reel 115. Advantageously our process includes, providing an undulatory creping member disposed to crepe the once creped cellulosic web from said Yankee/crepe dryer, the patented undulatory blade undulatory creping member compromising: an elongated blade adapted to be engageable against, and span the width of, the Yankee/crepe dryer, the blade having: a rake surface defined thereupon, extending generally outwardly from the Yankee when the blade is engaged against the Yankee/crepe dryer and extending across substantially the width of the Yankee/crepe dryer, a relief surface defined thereupon generally adjacent to the portion of the Yankee/crepe dryer from which the dried cellulosic web has been creped or recreped when the blade is engaged against the Yankee/crepe dryer and extending across substantially the width of the Yankee/crepe dryer, the intersection between the rake surface and the relief surface defining a serrulated engagement surface formed along the length of an elongated edge thereof, the serrulated engagement surface being adaptable to be engaged against the surface of the Yankee/crepe drying cylinder in surface-to-surface contact, the serrulated engagement surface constituting a spaced plurality of nearly planar crescent-shaped bands of width "δ", depth "λ" and span "ϵ" interspersed with, and interconnected by, a plurality of substantially co-linear rectilinear elongate regions of width "ϵ" and length "l," the initial width "ϵ" of the substantially rectilinear elongate regions being substantially less than the initial width "δ" of the nearly planar crescent-shaped bands of the serrulated engagement surface; the relief surface being configured so as to form a highly relieved foot contiguous to each nearly planar crescent-shaped band of the serrulated engagement surface; the length "l" of each of the plurality of substantially co-linear rectilinear elongate regions being between about 0.002 inch and 0.0084 inch and the span "σ" of each of the plurality of nearly planar crescent-shaped bands being between about 0.01 inch and 0.095 inch, the depth "λ" of each of the plurality of nearly planar crescent-shaped bands being between about 0.0080 inch and 0.0500 inch; and controlling the creping geometry such that: (a) the resulting recreped web exhibits from about 10 to about 150 crepe bars per inch, the crepe bars extending transversely in the cross machine direction and (b) the sheet exhibits undulations extending longitudinally in the machine direction, the number of longitudinally extending undulations per inch being from about 10 to about 50.

Our invention also comprises an improved process for production of a creped tissue web using the patented undulatory blade, including the steps of: forming a latent cellulosic web on a foraminous surface; adhering the latent cellulosic web to the surface of a Yankee dryer; drying the latent cellulosic web while in contact with the Yankee dryer to form a dried cellulosic web; and creping the dried cellulosic web from the Yankee dryer; wherein the improvement includes: for the creping of the dried cellulosic web, providing the patented undulatory blade having an undulatory cutting edge disposed to crepe the dried cellulosic web from the Yankee dryer; controlling the creping geometry and the adhesion between the Yankee dryer and the latent cellulosic web during drying such that the resulting tissue has from about 10 to about 150 crepe bars per inch, the crepe bars extending transversely in the cross machine direction, the geometry of the undulatory creping blade being such that the web formed has undulations extending longitudinally in the machine direction, the number of longitudinally extending undulations per inch being from about 10 to about 50.

Figure 15:
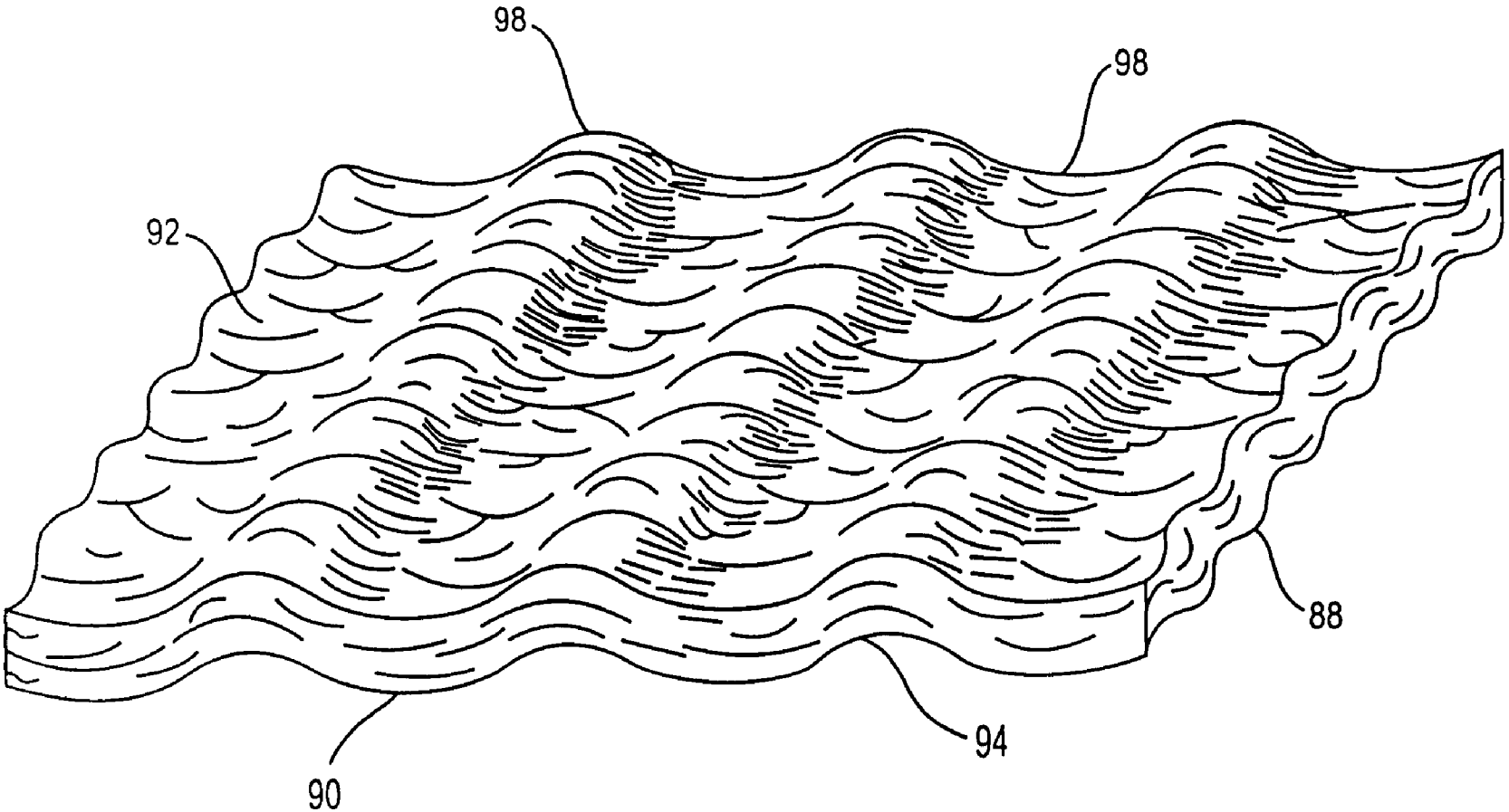
FIG. 15 schematically illustrates a creped web of the present invention.

Our invention particularly relates to a creped or recreped web as shown in FIG. 15 comprising a biaxially undulatory cellulosic fibrous web 88 creped from the Yankee dryer 70 shown in FIG. 10 using the patented undulatory blade, characterized by a reticulum of intersecting crepe bars 92, and undulations defining ridges 90 on the air side thereof, the crepe bars 92 extending transversely in the cross machine direction, the ridges 90 extending longitudinally in the machine direction, the web 88 having furrows 94 between the ridges 90 on the air side as well as crests 96 disposed on the Yankee side of the web opposite the furrows 94 and the surrations 98 interspersed between the crests 96 and opposite to the ridges 90, wherein the spatial frequency of the transversely extending crepe bars 92 is from about 10 to about 150 crepe bars per inch, and the spatial frequency of the longitudinally extending ridges 90 is from about 10 to about 50 ridges per inch. It should be understood that strong calendering of the sheet made with the patented undulatory blade can significantly reduce the height of the ridges 90, making them difficult to perceive by the eye, without loss of the beneficial effects of the patented undulatory blade.

The invention is also a paper web made according to the method described above. The paper product can be single-ply or multi-ply and can take the form of a tissue, a napkin or a towel.

In making a paper web using the patented undulatory blade, striations, or ridges, can be formed in the paper, imparting unattractive aesthetics in the form of a variation in topography in the paper web. These striations can vary the topography of the paper on the order of about 20%. This variation in topography finds reference in a product creped by a regular square blade as having a variation on the order of 0%.

The variation in topography in the paper web due to use of the undulatory blade can be determined by using a Fourier analysis as described below. A sample of product from a subject web is collected, and then illuminated with a macro-ring light positioned just above the sample in order to enhance the topography equally in all directions. An RS-170 camera (Dage-MTI Model 72) fitted with a 50 mm lens is then used for imaging. A focal distance of 19 inches is used, yielding an effective resolution 114 microns per pixel. This corresponds to a frequency resolution of 0.0044 cycles/pixel.

A 2-D Fourier transform is then used to convert each image, representing topography, from the spatial to the frequency domain. The resulting frequency image pairs is used to compute power spectra which is then polar averaged to produce a 1-D spectrum representing the distribution of power (or variation) as a function of frequency. This 1-D representation is easier to interpret and is rotation invariant.

Figure 18:
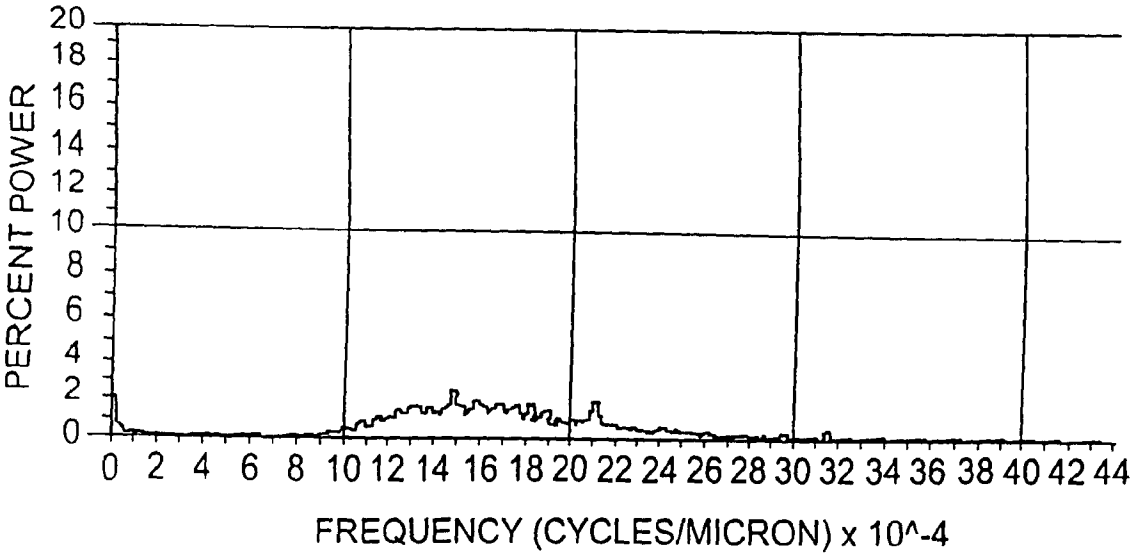
FIG. 18 illustrates a polar average spectra for a paper web creped with a standard square crepe blade.

To determine the effect on the variation in topography due to use of the undulatory blade, two base sheets were sampled: a square creped paper and an undulatory blade creped paper. In comparing the polar average spectra for the two base sheets (FIGS. 18 and 19), a strong characteristic peak at 0.00075 cycles/micron is clearly identifiable in the product produced with the undulatory blade. This peak equates to a variation in topography due to the undulatory blade of about 20%.

To reduce the visual effect of these striations, the pressed paper can be embossed. Embossing the paper masks the striations, thereby reducing the variation in topography. Embossing can be referred to as either "macro" or "micro" embossing. When "macro" embossing, a relatively large pattern is applied to the web. When "micro" embossing, a smaller pattern is applied to the web. It is also possible to have a macro/micro emboss, wherein both pattern-types are used on the same web. To achieve an acceptable level of reduction of variation in topography, at least about 5% of the surface area of the web should be embossed. However, up to at least 50% of the surface area can be embossed.

To emboss a paper web, the web is placed between two embossing rolls. There are various combinations of rolls that are acceptable: a rigid/resilient emboss system, i.e., a hard embossing roll and a soft embossing roll, mated or unmated, or a rigid/rigid emboss system, i.e., two hard embossing rolls, mated. In mated embossing, both of the emboss rolls between which the sheet passes are engraved with a matching or substantially matching pattern, such that protrusions in the pattern on one roll are matched with indentations of similar size and shape on the other roll. As discussed in the examples below, embossing can reduce the variation in topography due the undulatory crepe blade by 25% or greater, to more preferably 50% or greater, and still more preferably by about 59% or greater.

Figure 19:
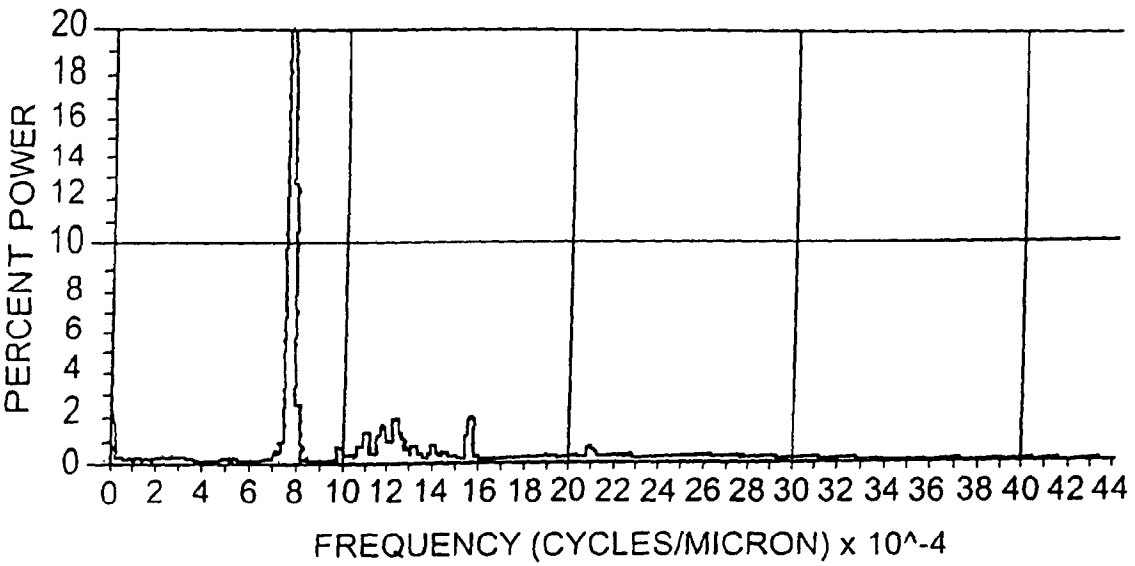
FIG. 19 illustrates a polar average spectra for a paper web creped with an undulatory blade.
Figure 20:
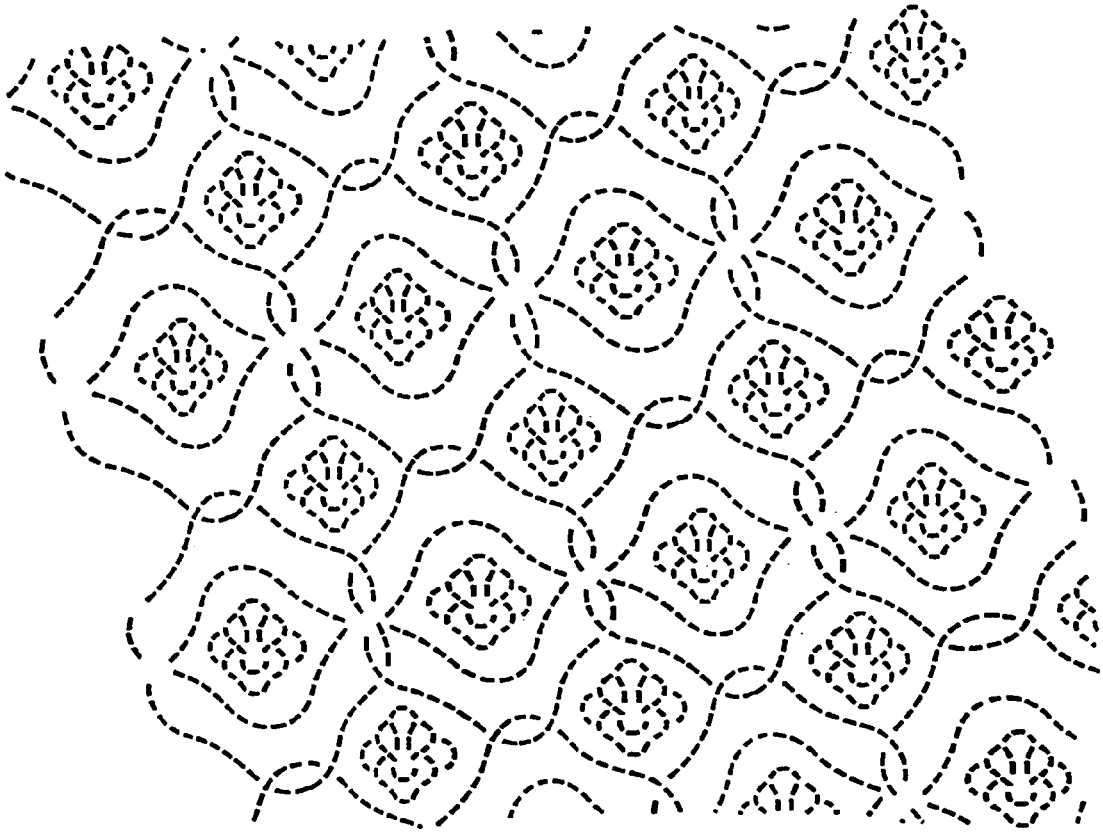
FIG. 20 illustrates a conventional emboss pattern that can be used to mask the undulatory serrations caused by use of the patented undulatory blade.
Figure 23:
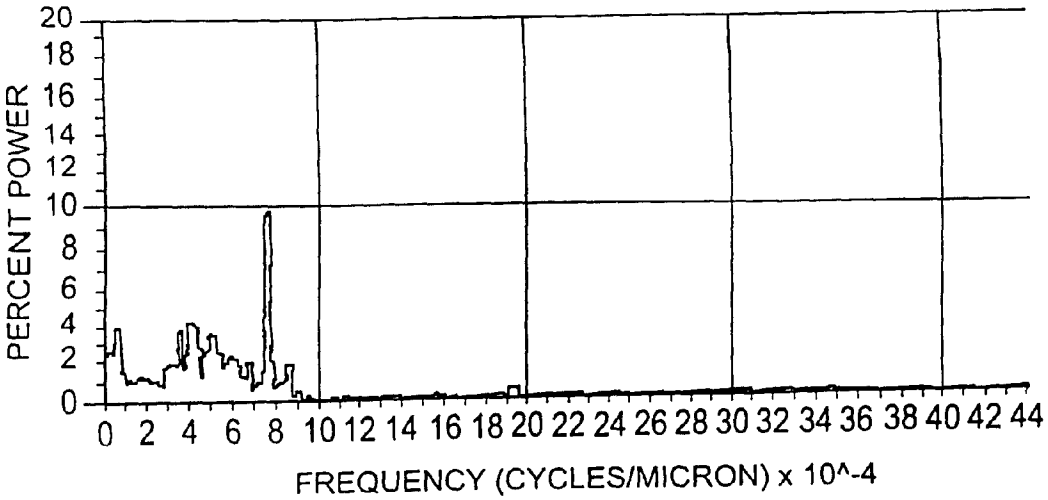
FIG. 23 illustrates a polar average spectra for a paper web creped with an undulatory blade and having a conventional emboss pattern.
Figure 24:
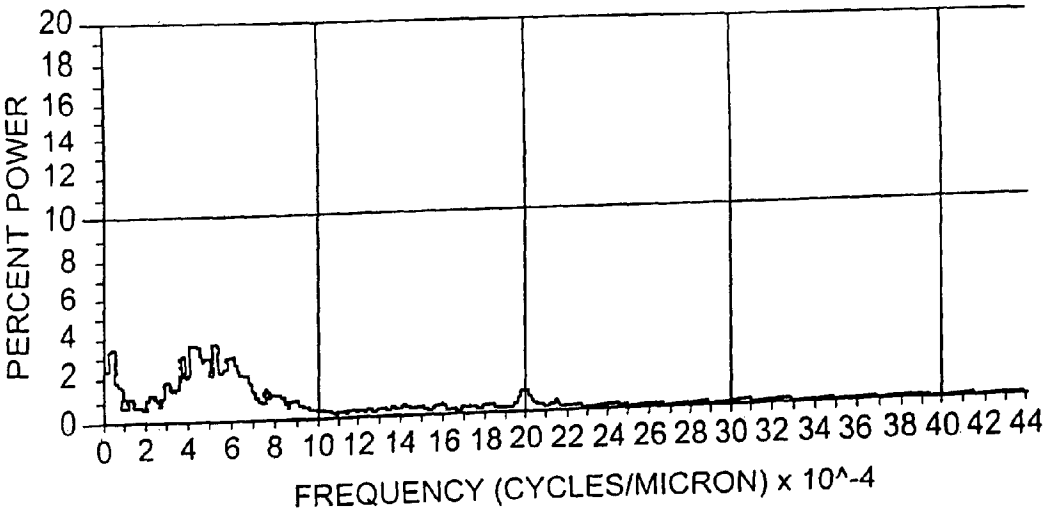
FIG. 24 illustrates a polar average spectra for a creped paper web having a conventional emboss pattern.

The undulatory crepe blade creates a distinct peak in the unembossed sheet topography at 0.00075 cycles/micron (FIG. 19). This peak is not seen in the square crepe blade sheet spectra of FIG. 18. FIG. 23 shows the effect of embossing the sheet from FIG. 19 with the FIG. 20 emboss pattern. The height of the peak at 0.00075 cycles/micron is reduced from 20% of the total variation to less than 10% of the total variation. This is a 50% reduction in the topography variation due to the undulatory crepe blade. The signal below 0.00075 cycles/micron in FIG. 23 is related to the emboss pattern. This can be seen by comparing the FIG. 23 spectra with the spectra in FIG. 24, which is the signal from the emboss pattern on the square crepe blade sheet of FIG. 18.

While the macro embossing improves the aesthetics of the tissue and the structure of the tissue roll and can lower the contribution to the total variation in topography due to the undulatory blade, the thickness of the base sheet between the signature emboss elements is actually reduced. This lowers the perceived bulk of a conventional wet-press (CWP) 1-ply product made by this process. Also, this process makes the tissue two-sided, as the male emboss elements create protrusions or knobs on only side of the sheet.

Smaller, closely spaced "micro" elements can be added to the emboss pattern to improve the perceived bulk of the rubber-to-steel emboss product. However, the result is a harsh product as small elements in a rubber-to-steel process create many small, stiff protrusions on one side of the tissue, resulting in a high roughness.

In a more preferred embodiment, the striated sheet is embossed using a "mated" embossing process. In a preferred mated embossing process, both of the emboss rolls between which the sheet passes are engraved with a matching pattern, such that protrusions in the pattern on one roll are matched with indentations of similar size and shape on the other roll. FIGS. 21*a-c* and 22 are illustrations of preferred mated emboss patterns of the present invention.

Figure 21A:
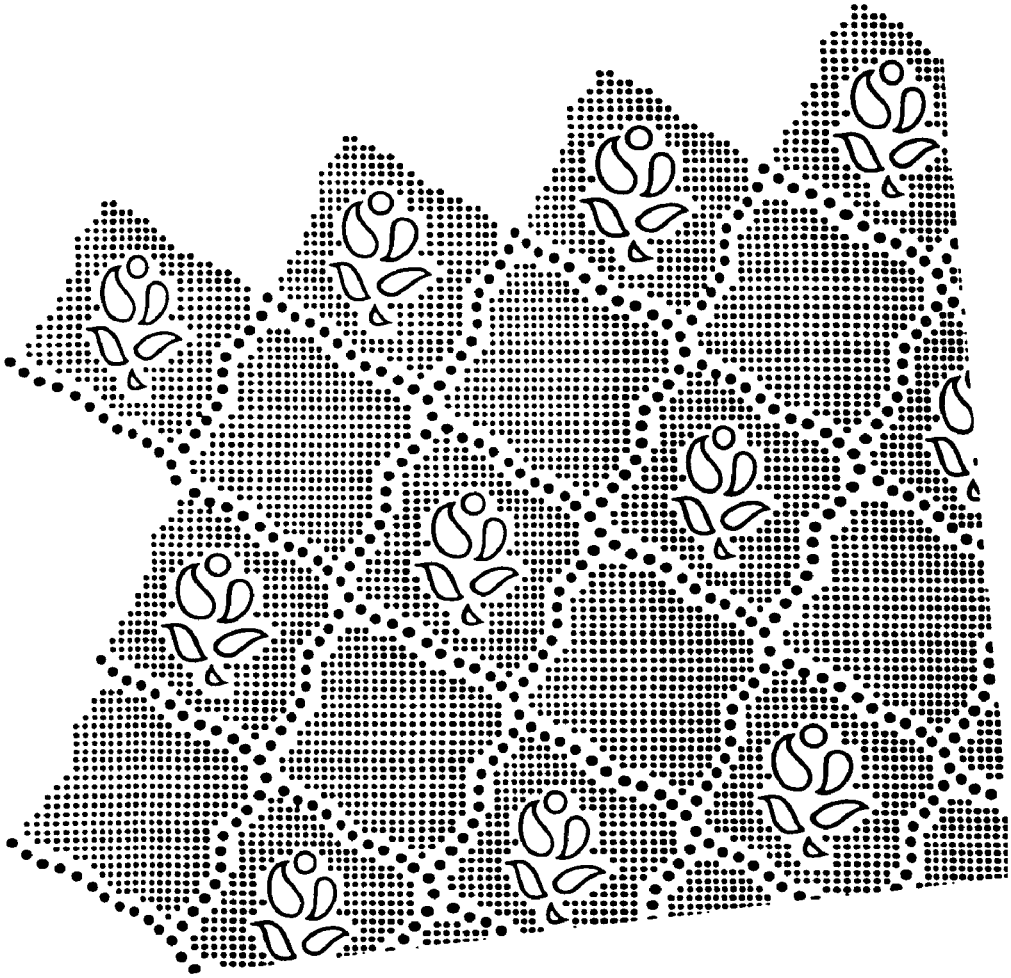
FIGS. 21*a*, 21*b*, and 21*c* illustrate one preferred mated emboss pattern that can be used to mask the undulatory serrations caused by use of the patented undulatory blade.
Figures 1, 21B:
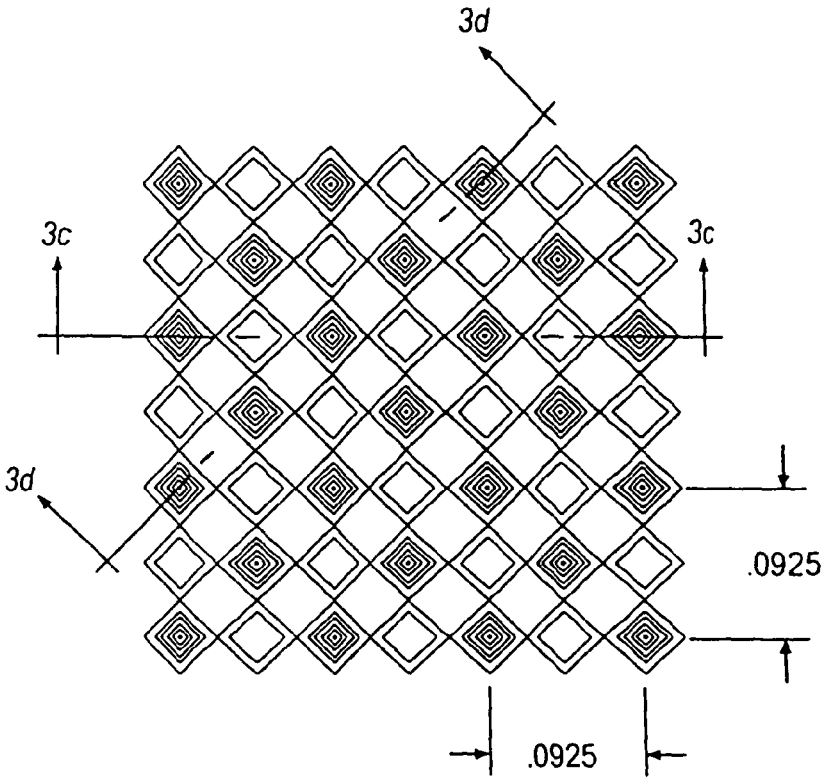
Figures 2, 21B:
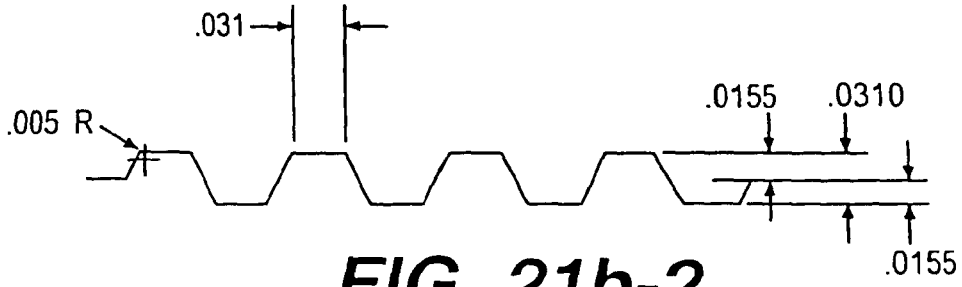
Figures 3, 21B:
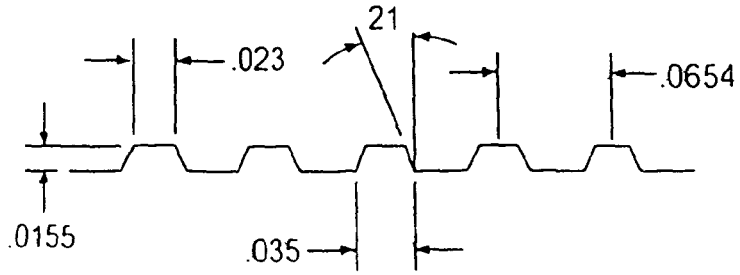
Figures 2, 21C:
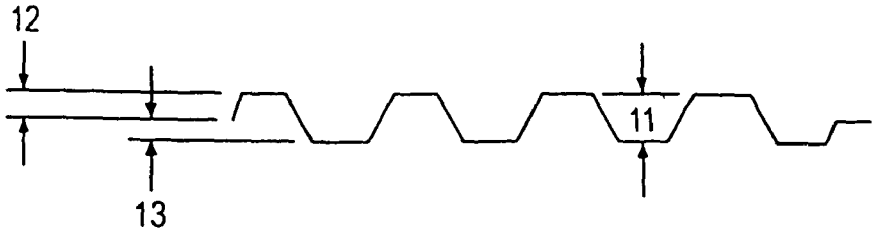
Figures 3, 21C:
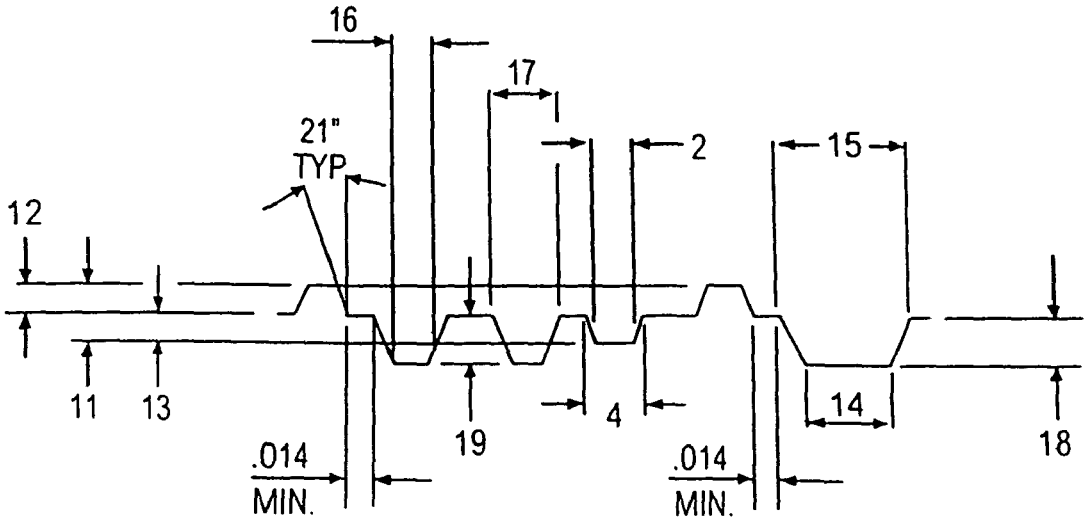
Figure 22:
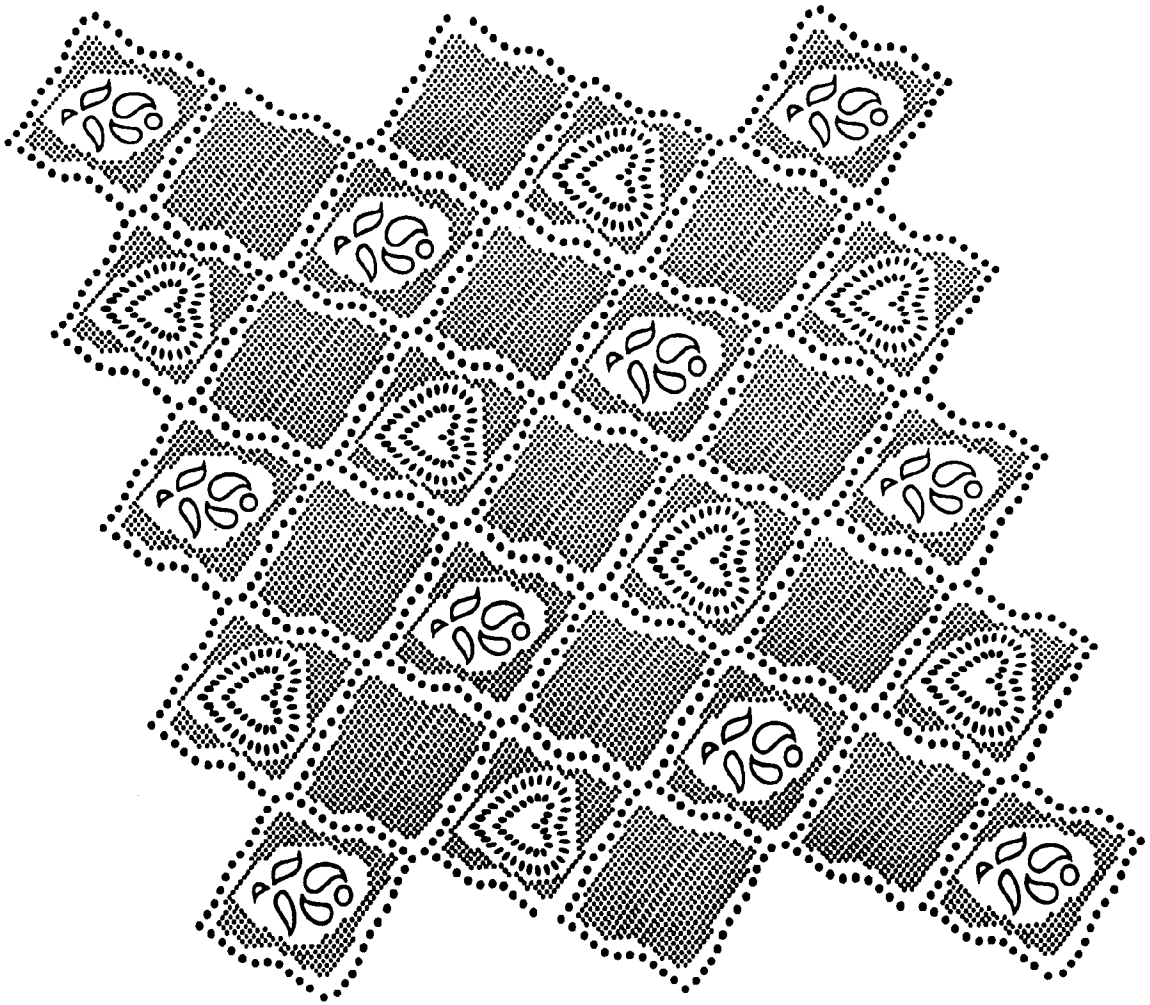
FIG. 22 illustrates another mated emboss pattern that can be used to mask the undulatory serrations caused by use of the patented undulatory blade.
Figure 25:
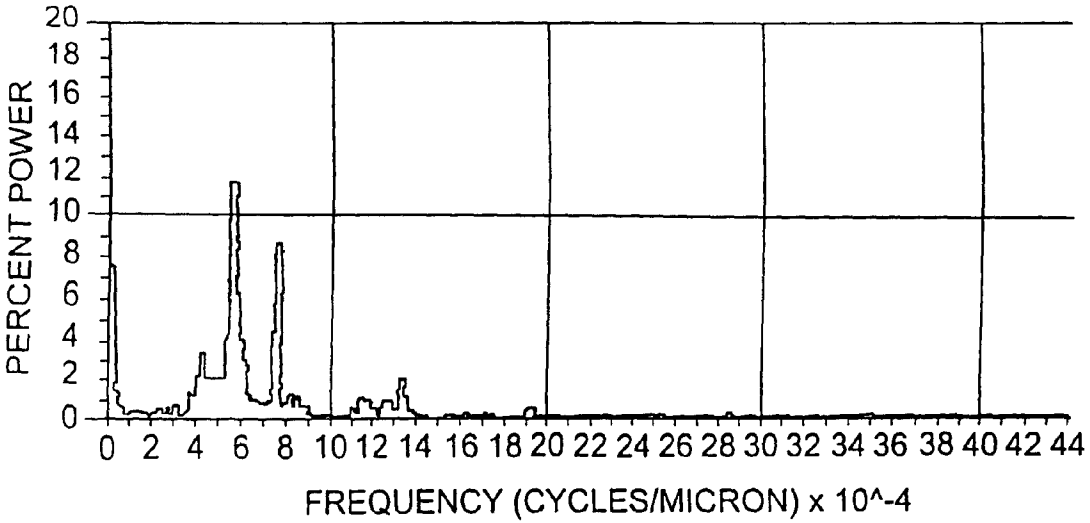
FIG. 25 illustrates a polar average spectra for a paper web creped with an undulatory blade and having a mated emboss pattern.
Figure 26:
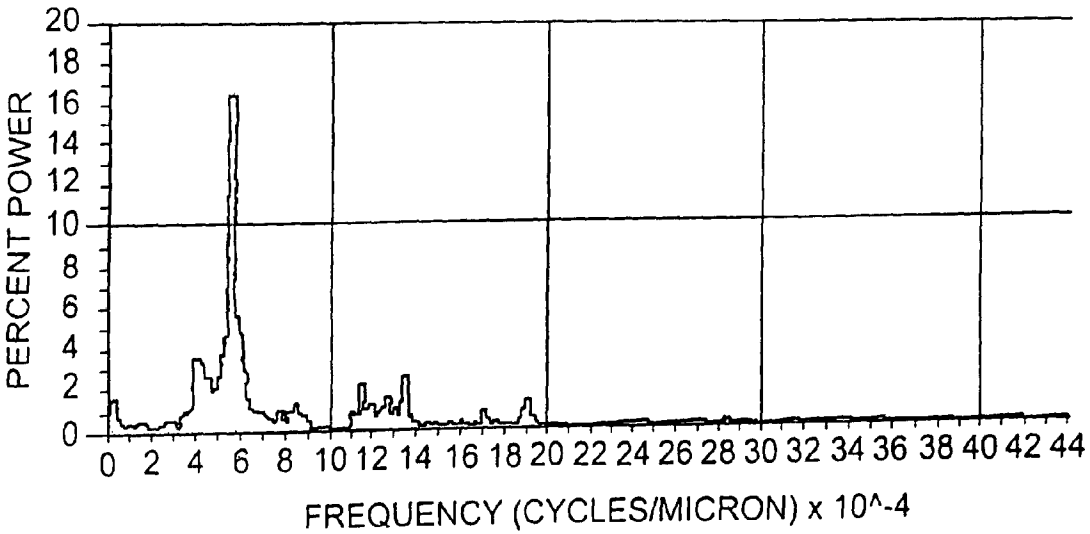
FIG. 26 illustrates a polar average spectra for a paper web creped with a standard square blade and having a mated emboss pattern.
Figure 27:
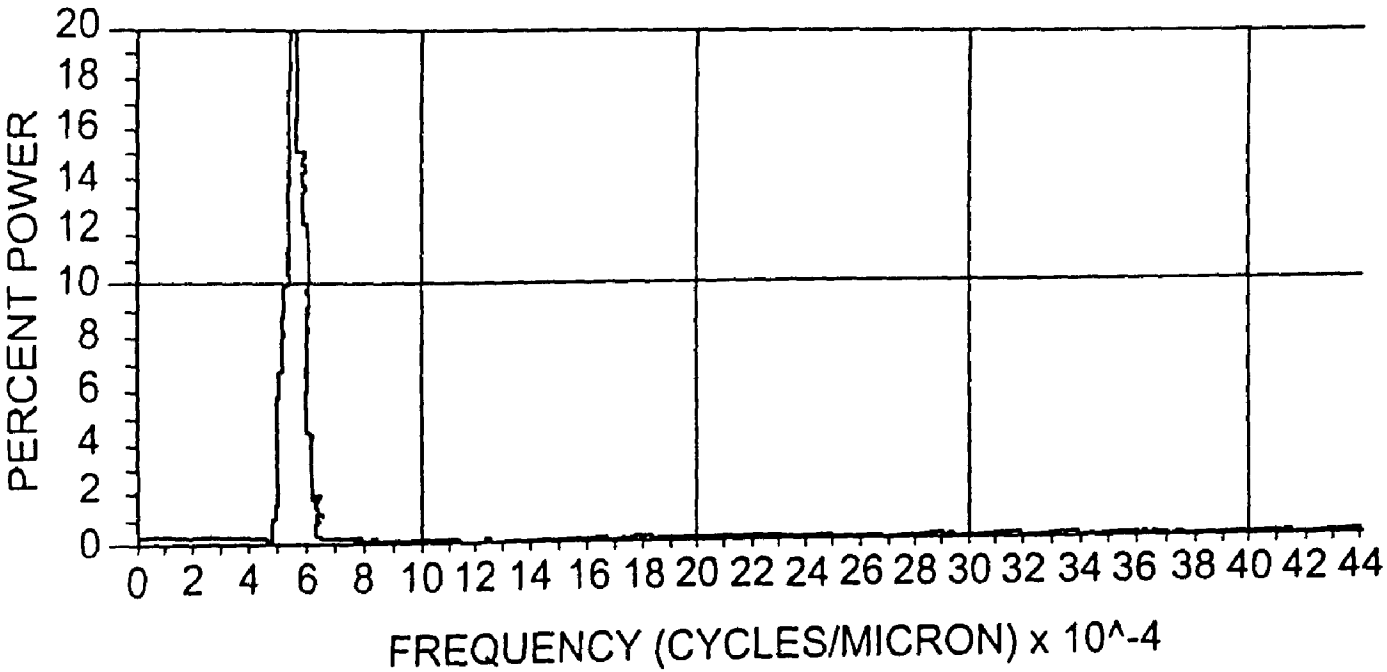
FIG. 27 illustrates a polar average spectra for a paper web creped with a standard square crepe blade having a mated emboss pattern with the spectra for the micro or fill emboss elements isolated.

Using the Fourier analysis described above, the effect of mated embossing on the creped web can be determined. The undulatory crepe blade creates a distinct peak in the unembossed sheet topography at 0.00075 cycles/Micron (FIG. 19). This peak is not seen in the square crepe blade sheet spectra of FIG. 18. FIG. 25 shows the effect of embossing the sheet from FIG. 19 with the FIG. 21*a* mated emboss pattern. The height of the peak at 0.00075 cycles/micron is reduced from 20% of the total variation to less than about 8.3% of the total variation. This is about a 59% reduction in the topography variation due to the undulatory crepe blade. Also, the signal at approximately 0.00055 cycles/micron is now the most prominent feature, which further masks the visual effects of the striations. FIG. 26 shows the spectra of the FIG. 21*a* mated emboss pattern on the square crepe blade base sheet of FIG. 18. FIG. 27 isolates the signal from the fill or micro elements. This demonstrates that the strong peak at 0.00055 cycles/micron is due to the fill or micro elements in the FIG. 21*a* mated emboss pattern. FIG. 21*b* shows the size, shape, and frequency of the micro elements in FIG. 21*a*. FIG. 21*c* shows in detail how the micro elements are combined with the signature or macro element to provide a more aesthetically pleasing emboss pattern.

The emboss rolls discussed above can be made of material such as steel or very hard rubber. In the process of embossing, the base sheet is only compressed between the sidewalls of the male and female element. Therefore, base sheet thickness is preserved and bulk perception of a one-ply product is much improved. FIGS. 21*a-c* shows a typical mated emboss pattern that can be used. The density and texture of the pattern improves bulk perception. This mated process and pattern also creates a softer tissue because the top of the tissue protrusion remains soft and uncompressed.

A preferred emboss pattern is shown in FIG. 21*b*. It contains diamond shaped male, female, and mid-plane element which all have a preferred width of 0.023". The shape of the elements can be selected as circles, squares, or other easily understood shapes. The height of the male elements above the mid-plane is preferably 0.0155" and the depth of the female elements is preferably 0.0155". The angle of the side walls of the elements is preferably 21°.

Patterns such as those shown in FIG. 21*b* can be combined with one or more signature emboss patterns to create products of the present invention. Signature bosses are an emboss design which is often related by consumer perception to the particular manufacturer of the tissue.

FIG. 21*c* is a closeup of the more preferred emboss pattern depicted in FIG. 21*a*. As shown in FIG. 21*c*, the emboss patterns combine the diamond micro pattern of FIG. 21*b* with a large, signature or "macro" pattern. This combination pattern provides aesthetical appeal from the macro pattern as well as the perceived bulk and texture perceived by the micro pattern. The macro portion of the pattern is mated so that it does not reduce softness by increasing the friction on the back side of the sheet. In addition to providing improved aesthetics, this pattern minimizes nesting and improves roll structure by increasing the repeat length for the pattern from 0.0925" to 5.0892".

The design of the macro elements in a more preferred emboss pattern preserves strength of the tissue. This is done by starting the base of the male macro element 50% below the mid-plane of the pattern as show in FIG. 21*c*. The female macro elements are started at the mid-plane as shown in FIG. 21*c*. This reduces the stretching of the sheet from the mid-plane by 50%. However, because the macro elements are still 31 mils in height or depth, they still provide a crisp, clearly defined pattern.

In one preferred emboss pattern the bases of male micro elements and the opening of female micro elements are separated by at least 0.007" away from the base of male macro elements or openings of female macro elements. In a more preferred emboss pattern, the bases of male micro elements and the opening of female micro elements are separated by at least 0.014" away from the base of male macro elements or openings of female macro elements. In a most preferred emboss pattern, the bases of male micro elements and the opening of female micro elements are separated by at least 0.020" away from the base of male macro elements or openings of female macro elements.

The effect of either the standard or mated embossing is to mask the striated topography caused by the undulatory crepe blade, thus producing a more aesthetically pleasing product.

The product has an ash content of from about 0.5% to about 25%, more preferably from about 1% to about 11%.

The product typically can display residual debonder in an amount of from about 0.03% to about 1%, more preferably, the products can display a residual debonder in an amount of from about 0.03% to about 0.5%, most preferably from about 0.15% to about 0.3%.

The product typically displays residual charge-modifying agents in an amount of from about 0.01% to about 0.6%, more preferably, the products display a residual charge-modifying agent in an amount of from about 0.01% to about 0.4%, most preferably from about 0.1% to about 0.3%.

The product displays retention aid in an amount of from about 0% to about 0.1%, more preferably, the products display a residual retention aid in an amount of from about 0.005% to about 0.08%, most preferably from about 0.01% to about 0.05%.

The product according to the present invention has an internal void volume preferably between about 5 and about 9, and still more preferably between about 6 and about 8. The product according to one aspect of the present invention has an internal void volume of greater than 6.5 regardless of breaking lengths. Products according to another aspect of the present invention exhibit a breaking length of less than about 1500 feet, more preferably less than about 1200 feet, most preferably less than about 900 feet, and may have a void volume as low as 5.0; however, the void volume is still more preferably 6.5 and above.

As used herein, "void volume" is determined by saturating a sheet with a nonpolar liquid and measuring the volume of liquid absorbed. The volume of liquid absorbed is equivalent to the void volume within the sheet structure. The void volume is expressed as grams of liquid absorbed per gram of fiber in the sheet. More specifically, for each single-ply sheet sample to be tested, select 8 sheets and cut out a 1 inch by 1 inch square (1 inch in the machine direction and 1 inch in the cross-machine direction). For multi-ply product samples, each ply is measured as a separate entity. Multi-ply samples should be separated into individual single plies and 8 sheets from each ply position should be used for testing. Weigh and record the dry weight of each test specimen to the nearest 0.001 gram. Place the specimen in a dish containing POROFIL® pore wetting liquid of sufficient depth and quantity to allow the specimen to float freely following absorption of the liquid. (POROFIL® liquid, having a specific gravity of 1.875 grams per cubic centimeter, available from Coulter Electronics, Ltd., Northwell Drive, Luton, Beds., England; Part No. 9902458.) After 10 seconds, grasp the specimen at the very edge (1-2 millimeters in) of one corner with tweezers and remove from the liquid. Hold the specimen with that corner uppermost and allow excess liquid to drip for 30 seconds. Lightly dab (less than ½ second contact) the lower corner of the specimen on #4 filter paper (Whatman Ltd., Maidstone, England) in order to remove any excess of the last partial drop. Immediately weigh the specimen within 10 seconds, recording the weight to the nearest 0.001 gram. The void volume for each specimen, expressed as grams of POROFIL per gram of fiber, is calculated as follows:

$$\text{Void Volume}=[(W_2-W_1)/W_1]$$

wherein $W_1$ is the dry weight of the specimen in grams; and $W_2$ is the wet weight of the specimen, in grams.

The void volume for all eight individual specimens is determined as described above and the average of the eight specimens is the void volume of the sample.

Figure 3:
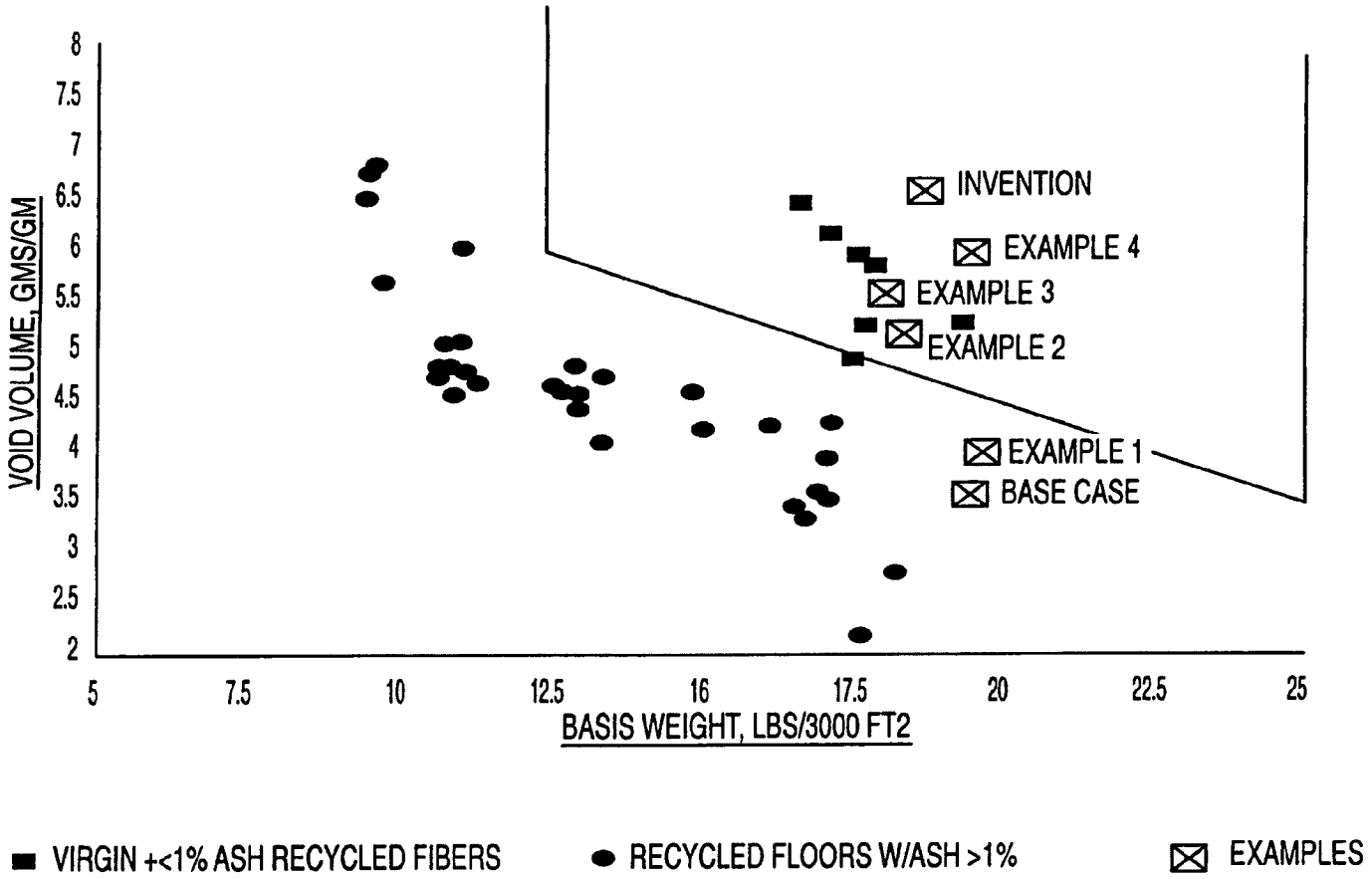
FIG. 3 illustrates the relationship between basis weight and void volume for different fibers types, including products according to the present invention.
Figure 4:
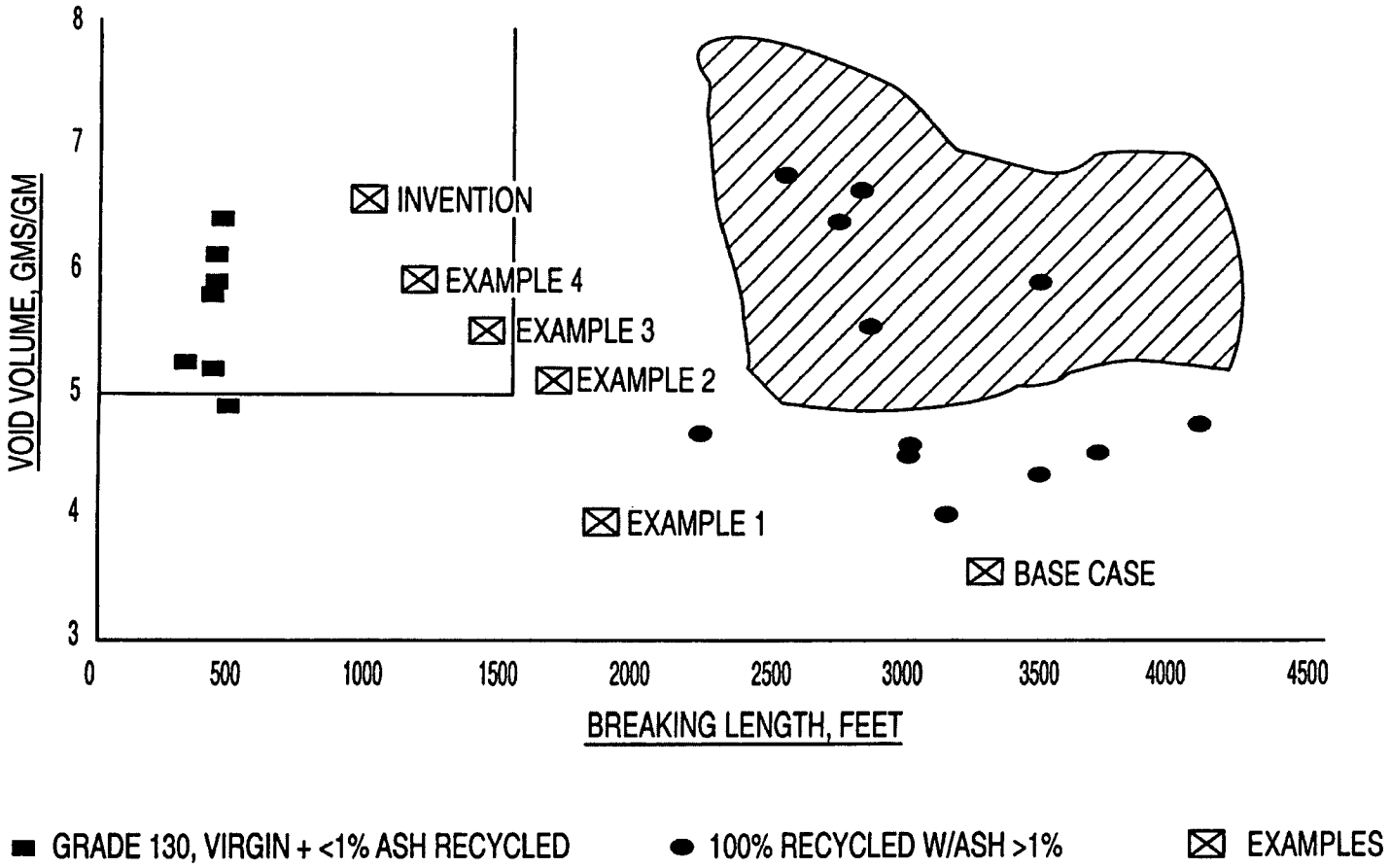
FIG. 4 illustrates the relationship between breaking length and void volume for different fiber types, including products according to the present invention.
Figure 5:
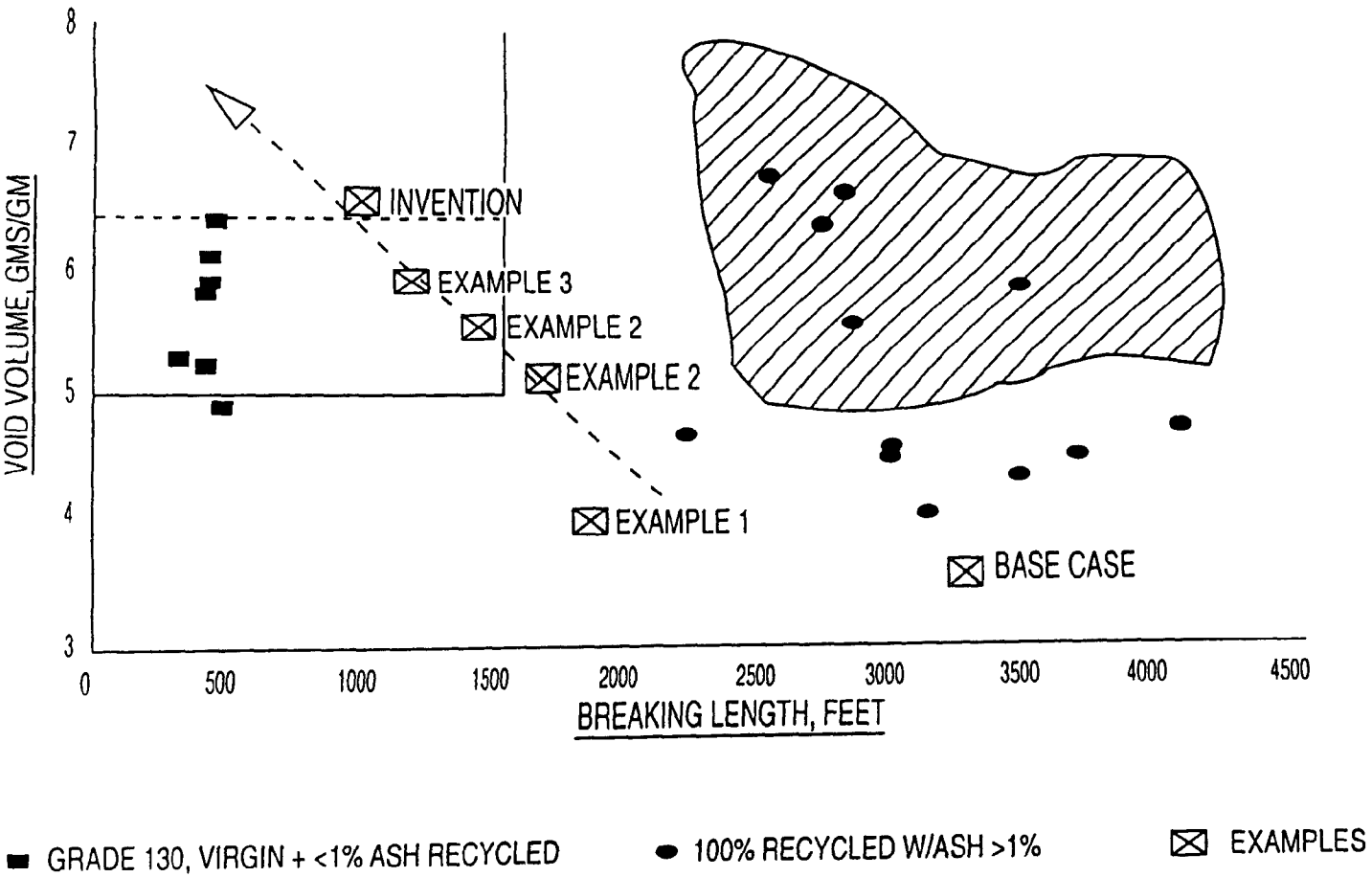
FIG. 5 illustrates the relationship between breaking length and void volume for furnishes containing different chemical treatments.

Products according to the present invention have a basis weight of from about 9 lbs to about 38 lbs. The relationship between basis weight and void volume is linear and is defined in FIG. 3. Products according to the present invention are on or above the line in FIG. 3 and conform to the equation:

$$\text{Void Volume} \geqq 8.4-(0.2\times\text{Basis Weight})$$

For products according to the present invention which contain a debonder, preferred product attributes include:

| | |
|---|---|
| Cond. Basis Weight (lb/rm) | 9-25 |
| Ash Content (%) | 1-15 |
| Caliper (mils/8 sheets) | 30-90 |
| MD Dry Tensile (g/3") | 500-1500 |
| CD Dry Tensile (g/3") | 300-1000 |
| (Geometric Mean)GM Dry Tensile (g/3") | 350-1250 |
| MD Stretch (%) | 10-30 |
| MD Wet Tensile (g/3") | <100 |
| CD Wet Tensile (g/3") | <100 |
| GM Wet Tensile (g/3") | <100 |
| CD W/D Tensile Ratio (g/3") | 0.10-0.4 |
| Absorbency (2-ply) (g/g) | 4-12 |
| GM Tensile Modulus (g/in/% strain) | 10-40 |

For products according to the present invention which contain a strength-adjusting agent, preferred product attributes include:

| | |
|---|---|
| Cond. Basis Weight (lb/rm) | 11-40 |
| Ash Content (%) | 1-30 |
| Caliper (mils) | 30-200 |
| MD Dry Tensile (g/3") | 1000-5000 |
| CD Dry Tensile (g/3") | 500-4000 |
| (Geometric Mean)GM Dry Tensile (g/3") | 700-4500 |
| MD Stretch (%) | 3-30 |
| MD Wet Tensile (g/3") | 100-2000 |
| CD Wet Tensile (g/3") | 100-1600 |
| GM Wet Tensile (g/3") | 100-1800 |
| CD W/D Tensile Ratio | 0.2-0.4 |
| Absorbency (2-ply) (g/g) | 4-12 |
| GM Tensile Modulus (g/in/% strain) (2-ply basis) | 20-200 |

Properties for products according to the present invention containing both debonders and strength-adjusting agents can range from the lowest values within either table to the highest values within either table. One- or two-ply tissue products are preferred products according to the present invention.

The following examples are illustrative of the invention embodied herein.

EXAMPLES

Example 1 (Comparative)

A tissue web was formed from a pulp (70 brightness), containing 10% ash. To the pulp was added water to form a thick stock. A web was formed from the pulp and dried using conventional wet pressing with application to a Yankee dryer. The adhesive used on the Yankee was Solvox 4450, which is a polyamineamide-epichlorohydrin resin adhesive available from Solvox Manufacturing Co., Milwaukee, Wis. The adhesive was applied to the Yankee dryer at a rate of 0.41 lbs/ton. A release agent, Solvox 5309, which is a mineral oil/surfactant release agent available from Solvox Manufacturing Co., Milwaukee, Wis., was also applied to the Yankee dryer at a rate of 0.51 lbs/ton. The creping angle was 78° and the percent crepe was 29%.

The resulting web had a basis weight of 19.6 lbs/3000 $ft^2$. The machine direction (MD) tensile was 580 g/in, the cross direction (CD) tensile was 365 g/in and the GM Tensile was 460 g/in.

This example shows that without any chemical additions, tensiles are well above the levels for products according to the present invention. The web produced according to this Example was very harsh to the touch and very "papery" when calendered to improve smoothness. By "papery," it is meant that what should have been a soft, absorbent sheet had characteristics that would appear in writing paper.

Examples 2 (Comparative)

A web was made in accordance with Example 1, except for the differences noted below. To the wet end of the papermaking machine was also added 4 lbs/ton of Quasoft 230 from Quaker Chemical Company. The creping angle was reduced to 76° and the Yankee adhesive was changed to Houghton 82-213 which is a polyamine amide-epichlorohydrin resin adhesive available from Houghton International Inc., Valley Forge, Pa., and was applied to the Yankee at a rate of 0.77 lbs/ton. The rate of application of the release agent was dropped to 0.31 lbs/ton and the crepe percent was reduced to 22%.

The web produced had a basis weight of 18.3 lbs/3000 sq. $ft^2$. The MD tensile of the first web was 520 g/in, the CD tensile was 290 g/in and the GM tensile was 388 g/in. The finished product had a basis weight of 18.1 lbs/3000 sq. $ft^2$. The MD tensile of the finished product was 2035 g/3 in, the CD tensile was 735 g/in, the opacity was 63.6%, the GM modulus was 30.2, the friction was 0.212 and the Sensory softness was 14.22.

Sensory softness is a subjectively measured tactile property that approximates consumer perception of tissue softness in normal use. Softness was measured by 20 trained panelists and includes comparison to a reference products that has previously been scaled. The results obtained are statistically converted to a useful comparative scale.

Example 3 (Comparative)

A web was prepared as in Example 2, except the amount of Quasoft 230 was raised to 4.9 lbs/ton. The basis weight of this web was 18 lbs/3000 sq. $ft^2$ (ream), the MD tensile was 425 g/in, the CD tensile was 245 g/in and the GM tensile was 323 gms/in.

The finished product had a basis weight of 17.9 lbs/3000 sq. $ft^2$. The MD tensile of the finished product was 1475 g/3 in, the CD tensile was 598 g/3 in, the opacity was 56.8%, the GM modulus was 22.1, the friction was 0.230 and the Sensory softness was 14.22.

Example 4 (Comparative)

A web was made in accordance with Example 2, except for the differences noted below. To the wet end of the papermaking machine was added 13 lbs/ton of Quasoft 230 and 0.5 lbs/ton of Nalco 7520 retention aid was also added. 2 lbs/ton of Quasoft 230 was also sprayed onto the web after it was formed. The creping angle was reduced to 68° and the Yankee adhesive was changed to Solvox 4450, a polyamineamide-epichlorohydrin resin adhesive available from Solvox Manufacturing Co., Milwaukee, Wis. and which was applied to the Yankee at a rate of 1.3 lbs/ton. The rate of application of the release agent was dropped to <0.05 lbs/ton and the crepe percent was reduced to 19.3%.

The base sheet web produced had a basis weight of 19.4 lbs/3000 sq. $ft^2$. The MD tensile of the web was 430 g/in, the CD tensile was 190 g/in, the GM tensile was 286 g/in, and the void volume was 6.0.

The finished, converted product had the following attributes:

| | |
|---|---|
| Basis weight (lbs/3000 sq. $ft^2$) | 18.2 |
| MD tensile (g/3 in) | 1060 |
| CD tensile (g/3 in) | 360 |
| Opacity (%) | 67.4 |
| GM Modulus | 17.0 |
| Friction | 0.240 |
| Sensory Softness | 15.5 |

While this example achieved a high void volume, the process was extremely difficult to control. The amount of debonder was high enough to interfere with the formation characteristics. The increased levels of debonder adversely affected the drainage in the forming section and to compensate, higher forming consistency was used to keep from flooding the former. In addition, the high amounts of debonder also adversely affected the Yankee coating.

Example 5

A web was made in accordance with Example 2, except for the differences noted below. To the wet end of the papermaking machine was added 3.5 lbs/ton of Quasoft 230, 4 lbs/ton of Cytec 573, a low-molecular-weight high charge density quaternary ammonium polymer from Cytec Industries, Inc., and 0.5 lbs/ton of Nalco 7520 retention aid. The creping angle was increased to 82° and the Yankee adhesive was changed to Solvox 4450, a polyamineamide-epichlorohydrin resin adhesive available from Solvox Manufacturing Co., Milwaukee, Wis. and which was applied to the Yankee at a rate of 0.72 lbs/ton. The rate of application of the release agent was dropped to <0.05 lbs/ton and the crepe percent was reduced to 20%.

The base sheet web produced had a basis weight of 18.6 lbs/3000 sq. $ft^2$. The MD tensile of the web was 440 g/in, the CD tensile was 120 g/in, the GM tensile was 230 g/in, and the void volume was 6.6.

The finished, converted product had the following attributes:

| | |
|---|---|
| Basis weight (lbs/3000 sq. $ft^2$) | 17.2 |
| MD tensile (g/3 in) | 1020 |
| CD tensile (g/3 in) | 345 |
| Opacity (%) | 66.8 |
| GM Modulus | 16.8 |
| Friction | 0.206 |
| Sensory Softness | 15.6 |

Because it was possible to reduce the % crepe while maintaining elevated void volume, the problems with process runnability were eliminated. Winding problems were also eliminated resulting in significantly increased productivity over Example 3. In addition, the Cytec 573 increased the effectiveness of the debonder and retention aid, allowing the forming nozzle to be opened up from 0.36 inches to 0.6 inches allowing better overall formation of the web.

The amounts and the effect of these chemistries on the drainage time are noted below in Table 1.

TABLE 1

| Example | Charge modifier (lbs/ton) | Debonder (lbs/ton) | Retention Aid (lbs/ton) | Drainage Time (sec) | Type |
|---|---|---|---|---|---|
| 1 | 0.00 | 0.00 | 0.00 | 75 | Comp. |
| 2 | 0.00 | 4.0 | 0.00 | 29-39 | Comp. |
| 3 | 0.00 | 4.9 | 0.00 | 29-39 | Comp. |
| 4 | 0.00 | 15.00 | 0.50 | 16-57 | Comp. |
| 5 | 4 | 3.5 | 0.50 | 7 | Inv. |

As used in the present application, drainage is measured by obtaining a representative 1000 gm sample from the headbox, placing a large 2000-4000 ml empty beaker on a top pan balance, positioning a smooth sided dynamic drainage jar containing a piece of forming fabric from the paper machine over the beaker, pouring the sample from the headbox through the drainage jar. The time required to drain 300 gms of filtrate from the sample is recorded as the drainage time.

Example 6

Towel with a basis weight in the range of from 12 to 30 lbs/ream is made from a furnish containing significant amounts of ash and fines by combining fiber containing a significant amount of ash and fines, usually a recycled fiber, with water to form a furnish. A charge modifier is added to the furnish at a point of high consistency, preferably above about 3%, and the furnish is mixed well, such as a pump inlet. The charge modifier is added before any strength-adjusting agent is added. The charge modifier is added at a rate so that the anionic charge on the through-80-mesh fraction of the furnish is reduced, e.g., to 30% of its original value. The charge modifier is added in an amount of from about 1 lb/ton to about 10 lb/ton, with preferred rates being 2 to 8 lbs/ton.

Next, a cationic strength-adjusting agent is added to the furnish. The strength-adjusting agent is added at a rate sufficient to generate the level of CD wet tensile desired without causing the suspended solids to become cationic, as measured at the headbox. Measurement can be made with streaming current detectors, electrophoretic mobility detectors or by means of polyelectrolyte titration. If insufficient cross-direction wet tensile is achieved through use of the cationic strength-adjusting agent alone, an auxiliary agent such as an anionic polymer, e.g., carboxymethylcellulose (CMC) can be added. The auxiliary agents are anionic, the skilled artisan would recognize that it may be necessary to control their addition ratios with the cationic materials to prevent the headbox from becoming cationic. Cationic strength-adjusting agents are preferably added in an amount of from about 4 to 30 lbs/ton. Auxiliary strength-adjusting agents are preferably added in an amount in the range of from about 0 lbs/ton to about 10 lbs/ton.

A retention aid is then added after the last zone of high shear, preferably after the pressure screen and just before the headbox. The retention aid is present in an amount of from 0 lbs/ton to about 4 lbs/ton, preferably greater than about 0.2 lb/ton and about 2 lbs/ton.

Example 7

A napkin product is formed from a web made with a pulp to which is added water to form a thick stock. To the thick stock is added a charge modifier in an amount sufficient to reduce the anionic charge on the through-80-mesh fraction of the furnish to about <30% of its original value. The charge modifier is added in an amount of from about 1 lb/ton to about 10 lbs/ton, more preferably 1 lb/ton to about 6 lbs/ton. If wetting disintegration resistance is required, a wet strength adjusting agent may be added. This is added in an amount sufficient to generate the level of CD wet tensile desired without taking the charge on the suspended solids cationic as measured at the headbox. If a wet strength adjusting agent is added, it is preferably added in an amount of from about 1 lb/ton to about 10 lbs/ton. Auxiliary agents may also be used. Auxiliary agents are preferably added in an amount of from about 2 lbs/ton to about 7 lbs/ton.

A softener or debonder is also an optional component in the formation of a napkin product. A softener or debonder may be added in an amount of from about 0 lb/ton to about 5 lbs/ton. While a softener or debonder, like a wet strength adjusting agent, is optional, napkin products contain at least one of a softener, a debonder or a wet strength adjusting agent and may in fact contain mixtures. A retention aid is then added in an amount of from about 0.1 lb/ton to about 4 lbs/ton, preferably between about 0.2 lb/ton and about 2 lbs/ton.

Example 8

One-ply tissue sheets were produced using a furnish that contained 100% recycled fibers. One lb/ton of Cytec® 573 (a low-molecular-weight, high-charge-density, quaternary ammonium compound), 8 lbs/ton of Quasoft® 230 (debonder), and 0.5 lbs/ton of Bufloc® 594 (retention aid) were added to the paper machine wet end. Prior to its being adhered to the Yankee dryer, the wet sheet was sprayed with two lbs/ton of Quasoft® 230. The adhesion between the tissue sheet and the Yankee dryer was controlled by a combination of Houghton 82-176 adhesive and Houghton 8302 release. The sheet was creped from the dryer at a moisture content of 2%, calendered between two steel rolls, and wound on the reel at a percent crepe of 25%.

Two base sheet variations were produced. One of these employed a standard crepe blade to remove the sheet from the Yankee dryer. The blade was positioned with respect to the dryer such that a 72° creping angle resulted. The other base sheet was creped using an undulatory crepe blade having 20 serrulations per inch with the depth of the serrulations being 0.020 inches. For this blade, the creping angle ($\alpha_f$) was 97°. The physical properties of the creped sheets are shown in Table 2. the data in the table indicate that the tissue sheet produced using the undulatory blade had higher caliper (both prior to and after calendering), lower tensile strength, higher CD stretch, and a higher bulk density than did the sheet made using the standard crepe blade. All of these changes are helpful in producing a softer tissue sheet.

TABLE 2

One-Ply Tissue Base Sheet Properties

| Crepe Blade | Basis Weight (lb/ream) | Uncalendered Caliper (mils/8 sht) | Calendered Caliper (mils/8 sht) | MD Tensile (gr/3") | CD Tensile (gr/3") | MD Stretch (%) | CD Stretch (%) | Void Volume |
|---|---|---|---|---|---|---|---|---|
| Square | 18.3 | 52.1 | 47.4 | 1246 | 1283 | 34.5 | 4.9 | 6.1 |
| Undulatory | 18.4 | 67.4 | 59.6 | 1114 | 843 | 33.0 | 6.8 | 6.9 |

Example 9

A one-ply tissue base sheet was produced from a furnish made entirely of secondary fiber. To the wet end of the paper machine were added 0.6 lbs/ton of Quaker 3190, a low-molecular-weight, high-charge-density, quaternary ammonium compound available from the Quaker Chemical Corporation of Conshohocken, Pa., 5.0 lbs/ton of Quasoft® 230 debonder, which is also available from Quaker Chemical, and 0.4 lbs/ton of Bufloc® 594 retention aid, available from Buckman Laboratories of Memphis, Tenn. The wet sheet was also sprayed with 2.0 lbs/ton of Quasoft 230 prior to its being pressed onto the Yankee dryer. A combination of Houghton 82-176 adhesive and Houghton 8302 release agent, both available from Houghton International, Inc. of Valley Forge, Pa., were used to control adhesion between the tissue sheet and the Yankee dryer. The sheet was creped from the Yankee dryer using a standard square crepe blade at a creping angle of 72°. After creping, the sheet was calendered between two steel rolls and the sheet was wound onto the reel at a percent crepe of 25%.

A second base sheet was also produced using the same conditions described above, except that the sheet was creped from the Yankee dryer using an undulatory creping blade. The blade had 20 serrulations per inch with the depth of the serrulations being 0.020 inches. The undulatory blade was positioned with respect to the Yankee dryer such that a creping angle ($\alpha_f$) of 97° resulted. The physical properties of the two tissue base sheets are shown in Table 3. As can be seen from the table, the base sheet produced using the undulatory blade has lower tensile strength, higher caliper, CD stretch, and void volume than does its counterpart that was creped using a standard blade. All of these changes have been shown to positively impact the handfeel of one-ply tissue products.

TABLE 3

One-Ply Tissue Base Sheet Properties

| Crepe Blade | Basis Weight (lb/ream) | Caliper (mils/8 sht) | MD Tensile (gr/3") | CD Tensile (gr/3") | MD Stretch (%) | CD Stretch (%) | Void Volume |
|---|---|---|---|---|---|---|---|
| Square | 19.1 | 44.5 | 1113 | 1007 | 31.3 | 5.0 | 5.2 |
| Undulatory | 19.0 | 59.6 | 987 | 766 | 31.6 | 6.7 | 6.0 |

The two base sheets were converted to finished one-ply tissue processes by embossing. Two emboss processes were employed for each base sheet. In one case, the base sheet was embossed using "standard" emboss configuration in which the sheet is pressed between a hard engraved patterned roll and a softer, smooth backing roll. In the second case, the sheets were embossed using a "mated" embossing process. For mated embossing, both of the emboss rolls between which the sheet passes are engraved with a pattern, such that protrusions in the pattern on one roll are matched by indentations of similar size and shape on the other roll.

The physical properties of products made from the two base sheets by each of the two embossing processes are shown in Table 4. the table also shows the sensory softness of the products. For both emboss processes, the products made using the base sheet crepe with the undulatory crepe blade had a higher softness value than did its counterpart that was creped using a standard creping blade. In addition, the products produced using the mated emboss process were softer than were the corresponding product made with a standard embossing technique.

TABLE 4

Embossed Product Physical properties and Sensory Softness

| Crepe Blade | Emboss Process | Basis Weight (lb/ream) | Caliper (mils/8 sht) | MD Tensile (gr/3") | CD Tensile (gr/3") | MD Stretch (%) | CD Stretch (%) | Sensory Softness |
|---|---|---|---|---|---|---|---|---|
| Square | Standard | 17.8 | 65.0 | 697 | 343 | 17.5 | 6.4 | 16.33 |
| Undulatory | Standard | 17.7 | 66.5 | 593 | 356 | 18.3 | 6.9 | 17.09 |
| Square | Mated | 17.8 | 62.2 | 675 | 392 | 19.1 | 6.9 | 16.66 |
| Undulatory | Mated | 17.6 | 64.7 | 660 | 386 | 18.7 | 7.6 | 17.51 |

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

We claim:

1. A method for forming a soft absorbent paper product comprising:

supplying a furnish comprising fibers in an aqueous stream;

adding a charge modifier to said furnish wherein said charge modifier contacts said furnish for a time sufficient to reduce the charge in the furnish;

adding a debonder to said furnish, after said charge has been reduced;

adding a retention aid to said furnish after said debonder or wet has been in contact with said furnish for a time sufficient to allow distribution of said debonder on said fibers;

supplying said furnish to a headbox, and wherein said furnish has a consistency of not greater than 0.9% as supplied to the headbox;

applying said furnish to a forming wire and forming a nascent web; and drying said web to form a paper product.

2. The method according to claim 1, wherein said drying step comprises:

compactively dewatering said nascent web;

applying said web to a Yankee dryer and drying said web; and creping said web from said Yankee at a moisture content of less than about 50%.

3. The method according to claim 2, wherein the moisture content during creping is less than about 15%.

4. The method according to claim 3, wherein the moisture content during creping is less than about 6%.

5. The method of claim 2, wherein said web is creped using an undulatory crepe blade which produces said absorbent paper product, said web having a machine direction and a cross machine direction and said web having a Yankee side and an air side, comprising a biaxially undulatory cellulosic fibrous web characterized by a reticulum of intersecting undulations and crepe bars, said crepe bars extending transversely in the cross machine direction, said undulations defining: interspersed ridges and furrows extending longitudinally in the machine direction on the air side of the sheet; along with interspersed crests and sulcations disposed on the Yankee side of the web, wherein the spatial frequency of said transversely extending crepe bars is from about 10 to about 150 crepe bars per inch, and the spatial frequency of said longitudinally extending ridges is from about 10 to 50 ridges per inch such that the total variation in the topography of the web is about 20%.

6. The method of claim 5, wherein creping of said web produces said absorbent paper product wherein the thickness of the portion of said tissue adjoining said longitudinally extending crests is at least about 5% greater than the thickness of the portions of said tissue adjoining said sulcations.

7. The method of claim 5, wherein creping of said web produces said absorbent paper product wherein the thickness of the portion of said web adjoining said crests is substantially greater than the thickness of the portions of said tissue adjoining said sulcations.

8. The method of claim 5, wherein creping of said web produces said absorbent paper product wherein the average density of the portion the tissue in said crests is less than the density of said tissue in said sulcations.

9. The method of claim 5, wherein creping of said web produces said absorbent paper product wherein the nascent web is subjected to overall compaction while the percent solids is less than fifty percent by weight.

10. The method of claim 5, wherein creping of said web produces said absorbent paper product wherein fibers in the tissue crests project acutely therefrom and the average density of the portion of the tissue adjacent said crests is less than the density of said tissue adjacent said sulcations.

11. The method of claim 5, wherein the tensile strength in the resulting web produced by said undulatory creping has been reduced by at least 10% of the lowest strength web produced without the use of said undulatory creping blade.

12. The method of claim 11, wherein the tensile strength in the resulting web produced by said undulatory creping has been reduced by at least 15% of the lowest strength web produced without the use of said undulatory creping blade.

13. The method of claim 5, wherein the web is embossed between a hard embossing roll and a smooth, softer embossing roll, and wherein the total variation in topography due to the undulatory crepe blade is reduced by about 25%.

14. The method of claim 13, wherein the total variation in topography due to the undulatory crepe blade is reduced by about 50%.

15. The method of claim 5, wherein the web is embossed between mated emboss rolls and wherein the total variation in topography due to the undulatory crepe blade is reduced by about 35%.

16. The method of claim 15, wherein the total variation in topography due to the undulatory crepe blade is reduced by about 59%.

17. The method of claim 5, wherein the after-calendering caliper in the resulting web produced by said undulatory creping has been increased by at least about 25% over the caliper of the web as produced without the use of said undulatory creping blade.

18. The method of claim 17, wherein the after-calendering caliper in the resulting web produced by said undulatory creping has been increased by at least about 33% over the caliper of the web as produced without the use of said undulatory creping blade.

19. The method of claim 5, wherein the cross-directional stretch in the resulting web produced by said undulatory creping has been increased by at least about 38% over the cross-directional stretch of the web as produced without the use of said undulatory creping blade.

20. The method according to claim 1, wherein the consistency of the furnish as supplied to the headbox is less than about 0.7%.

21. The method according to claim 20, wherein the consistency of the furnish as supplied to the headbox is less than about 0.5%.

22. The method according to claim 1, wherein the furnish contains greater than about 1% ash.

23. The method according to claim 22, wherein the furnish contains greater than about 2% ash.

24. The method according to claim 23, wherein the furnish contains greater than about 4% ash.

25. The method according to claim 1, wherein the furnish contains only recycled fibers.

26. The method according to claim 1, wherein the charge modifier is added in an amount of from about 1 lb/ton to about 10 lbs/ton.

27. The method according to claim 26, wherein the charge modifier is added in an amount of from about 2 lbs/ton to about 6 lbs/ton.

28. The method according to claim 1, further comprising adding a softener.

29. The method according to claim 28, wherein the softener is added to the furnish prior to the addition of said retention aid.

30. The method according to claim 28, wherein the softener is sprayed onto the web after formation.

31. The method according to claim 1, wherein the debonder is added in an amount of from about 1 lb/ton to about 20 lbs/ton.

32. The method according to claim 1, wherein the debonder contains an imidazolinium compound.

33. The method according to claim 1, wherein said drying is through-air-drying.

34. A method for improving the retention of a softener or debonder in a web produced from a furnish containing contaminants selected from ash, fines, filler and mixtures thereof comprising, in the following order:

adding to said furnish a charge-modifying agent capable of neutralizing the charge on said contaminants, allowing the charge-modifying agent to contact the furnish for a time sufficient to neutralize charge on said contaminants;

adding to said furnish a softener or debonder;

adding to said furnish a retention aid;

forming a nascent web from said furnish; and drying said web, wherein the charge on the contaminants has been reduced by at least 70% of the original value.

* * * * *

UNITED STATES PATENT AND TRADEMARK OFFICE

CERTIFICATE OF CORRECTION

PATENT NO. : 7,794,566 B2
APPLICATION NO. : 10/964613
DATED : September 14, 2010
INVENTOR(S) : Steven L. Edwards et al.

It is certified that error appears in the above-identified patent and that said Letters Patent is hereby corrected as shown below:

In claim 1, column 34, lines 14-15, after "debonder" delete "or wet".

Signed and Sealed this
Twenty-eighth Day of June, 2011

David J. Kappos

David J. Kappos
*Director of the United States Patent and Trademark Office*